US010637151B2

(12) United States Patent
Kang et al.

(10) Patent No.: US 10,637,151 B2
(45) Date of Patent: Apr. 28, 2020

(54) TRANSCEIVER IN WIRELESS COMMUNICATION SYSTEM

(71) Applicant: Electronics and Telecommunications Research Institute, Daejeon (KR)

(72) Inventors: Min Soo Kang, Daejeon (KR); Bong Su Kim, Daejeon (KR); Kwang Seon Kim, Sejong-si (KR); Myung Sun Song, Daejeon (KR); Woo Jin Byun, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 33 days.

(21) Appl. No.: 15/958,981

(22) Filed: Apr. 20, 2018

(65) Prior Publication Data

US 2018/0316095 A1 Nov. 1, 2018

(30) Foreign Application Priority Data

Apr. 26, 2017 (KR) ..... 10-2017-0053484

(51) Int. Cl.
*H01Q 15/14* (2006.01)
*H01Q 19/19* (2006.01)

(52) U.S. Cl.
CPC ..... *H01Q 15/148* (2013.01); *H01Q 19/191* (2013.01)

(58) Field of Classification Search
CPC ..... H01Q 15/148; H01Q 19/191
See application file for complete search history.

(56) References Cited

U.S. PATENT DOCUMENTS 3,281,850 A * 10/1966 Hannan ..... H01Q 5/45 343/756
3,763,493 A * 10/1973 Shimada ..... H01Q 19/104 343/755
3,953,858 A * 4/1976 Ohm ..... H01Q 19/191 343/779
4,145,695 A * 3/1979 Gans ..... H01Q 25/007 343/779
4,166,276 A * 8/1979 Dragone ..... H01Q 19/191 343/781 P
4,339,757 A * 7/1982 Chu ..... H01Q 19/191 343/781 CA
4,342,036 A * 7/1982 Scott ..... H01Q 5/45 343/836
4,343,004 A * 8/1982 Ohm ..... H01Q 19/191 343/781 P (Continued)

FOREIGN PATENT DOCUMENTS

KR 1020160131400 A 11/2016
WO WO-2016036270 A1 * 3/2016 ..... H01Q 3/40

*Primary Examiner* — Hai V Tran
*Assistant Examiner* — Bamidele A Jegede
(74) *Attorney, Agent, or Firm* — William Park & Associates Ltd.

(57) ABSTRACT

A transceiving apparatus may comprise a radiator emitting a beam; a receiver receiving a beam; a first sub-reflector which is provided to face the radiator and changes an orbital angular momentum (OAM) mode order of a beam; a second sub-reflector which is provided to face the receiver and changes an OAM mode order of a beam differently from the first sub-reflector; and a main reflector which is provided to face the first sub-reflector and the second sub-reflector.

20 Claims, 18 Drawing Sheets

(56) References Cited

U.S. PATENT DOCUMENTS 4,484,197 A * 11/1984 Dragone ..... H01Q 19/191 343/779
4,491,848 A * 1/1985 Dragone ..... H01Q 19/191 343/781 P
5,793,334 A * 8/1998 Anderson ..... H01Q 13/02 333/126
5,805,116 A * 9/1998 Morley ..... H01Q 19/17 343/779
5,835,057 A * 11/1998 van Heyningen ... H01Q 1/3216 342/359
6,031,507 A * 2/2000 Aoki ..... H01Q 19/17 343/776
6,496,156 B1 * 12/2002 Lusignan ..... H01Q 13/0266 343/781 P
6,545,645 B1 * 4/2003 Wu ..... H01Q 19/104 343/781 CA
6,642,889 B1 * 11/2003 McGrath ..... H01Q 1/38 343/700 MS
9,240,917 B2 1/2016 Chen et al.
9,294,259 B2 3/2016 Jalloul et al.
9,350,084 B1 5/2016 Harris et al.
2002/0196194 A1 * 12/2002 Lier ..... H01Q 13/025 343/786
2004/0257290 A1 * 12/2004 Gothard ..... H01Q 3/0266 343/781 CA
2005/0083241 A1 * 4/2005 Zarro ..... H01Q 13/025 343/786
2005/0219125 A1 * 10/2005 Charrier ..... H01Q 3/46 343/700 MS
2007/0057860 A1 * 3/2007 Jaffer ..... H01Q 1/125 343/779
2007/0132651 A1 * 6/2007 Nilsson ..... H01Q 1/242 343/781 P
2010/0238082 A1 * 9/2010 Kits van Heyningen ..... H01Q 3/08 343/761
2010/0295753 A1 * 11/2010 Robson ..... H01Q 1/288 343/914
2011/0012801 A1 * 1/2011 Monte ..... H01Q 1/288 343/762
2012/0326939 A1 * 12/2012 Cannon ..... H01Q 19/027 343/840
2013/0208332 A1 * 8/2013 Yu ..... G02F 1/01 359/240
2013/0235744 A1 * 9/2013 Chen ..... H04L 47/82 370/252
2014/0044043 A1 * 2/2014 Moshfeghi ..... H04W 84/00 370/328
2014/0218255 A1 * 8/2014 Sanford ..... H01Q 1/525 343/837
2014/0220903 A1 * 8/2014 Schulz ..... H01Q 19/12 455/67.7
2014/0355624 A1 * 12/2014 Li ..... H04L 27/00 370/468
2015/0029070 A1 1/2015 Ohshima et al.
2015/0102973 A1 * 4/2015 Hand ..... H01Q 15/14 343/836
2015/0139284 A1 5/2015 Choi et al.
2015/0146815 A1 * 5/2015 Berretta ..... H04L 5/04 375/279
2015/0188660 A1 7/2015 Byun et al.
2016/0028163 A1 * 1/2016 Li ..... H01Q 21/00 343/836
2016/0033406 A1 * 2/2016 Ashrafi ..... G01N 21/17 356/432
2016/0315395 A1 10/2016 Byun et al.
2017/0005415 A1 * 1/2017 Adada ..... H01Q 3/20
2017/0026095 A1 * 1/2017 Ashrafi ..... H04B 7/10
2017/0062910 A1 * 3/2017 Iida ..... H01Q 13/08
2017/0163451 A1 * 6/2017 Willner ..... H04B 7/0413
2017/0230115 A1 * 8/2017 Ashrafi ..... H04B 10/2504
2018/0034556 A1 * 2/2018 Willner ..... H04B 10/1121

* cited by examiner

TRANSCEIVER IN WIRELESS COMMUNICATION SYSTEM

CROSS-REFERENCE TO RELATED APPLICATIONS

This application claims priority to Korean Patent Application No. 10-2017-0053484 filed on Apr. 26, 2017 in the Korean Intellectual Property Office (KIPO), the entire contents of which are hereby incorporated by reference.

BACKGROUND

1. Technical Field

The present disclosure relates to a transceiving apparatus, and more specifically, to a transceiving apparatus which can reduce interferences between transmission signals and reception signals in a full duplex scheme based communication system.

2. Related Art

As mobile communication devices are distributed, the number of Internet accesses of the mobile devices surpassed the number of Internet accesses of personal computers (PCs), and most of the total number of Internet accesses now occur in the mobile devices. As the wireless communication environment is activated, the traffic volume of smart phones is steadily increasing. Accordingly, various technologies that can increase the communication capacity have been developed.

Time division multiplexing (TDM), frequency division multiplexing (FDM), and code division multiplexing (CDM) are used as a multiplexing scheme for increasing the communication capacity. Recently, a study on a multiplexing scheme using an orbital angular momentum (OAM) has been conducted to increase the communication capacity. The OAM is a physical property of a beam determined by a wavefront shape of the beam. A transmitting end can transmit different data through beams having different OAMs, thereby increasing the data transmission capacity. Also, a receiving end can selectively recover a beam having a specific OAM to recover the data.

In a full duplex scheme, since transmission and reception of signals are performed at the same time, the communication capacity can be doubled compared to the conventional communication scheme. However, there is a problem that in the full duplex scheme, transmission signals of a transceiver interfere with reception signals, thereby deteriorating communication quality.

SUMMARY

Accordingly, embodiments of the present disclosure provide a transceiving apparatus which can reduce interferences between a transmission signal and a reception signal by controlling OAM modes of the transmission signal and the reception signal in a full duplexing scheme based communication system.

In order to achieve the objective of the present disclosure, a transceiving apparatus may comprise a radiator emitting a beam; a receiver receiving a beam; a first sub-reflector which is provided to face the radiator and changes an orbital angular momentum (OAM) mode order of a beam; a second sub-reflector which is provided to face the receiver and changes an OAM mode order of a beam differently from the first sub-reflector; and a main reflector which is provided to face the first sub-reflector and the second sub-reflector.

The first sub-reflector may decrease an OAM mode order of a beam, and the second sub-reflector may increase an OAM mode order of a beam.

The radiator may include a first mode conversion unit increasing an OAM mode order of the beam emitted by the radiator, and the receiver may include a second mode conversion unit decreasing an OAM mode order of the beam incident on the receiver.

The sub-reflector may increase an OAM mode order of a beam, and the second sub-reflector may decrease an OAM mode order of a beam.

The radiator may include a first mode conversion unit decreasing an OAM mode order of the beam emitted by the radiator, and the receiver may include a second mode conversion unit increasing an OAM mode order of the beam incident on the receiver.

The main reflector may include at least one first patch element increasing an OAM mode order of a beam reflected at the main reflector, and at least one second patch element decreasing an OAM mode order of the beam reflected at the main reflector.

The first sub-reflector may decrease an OAM mode order of a beam reflected at the first sub-reflector, and the second sub-reflector may increase an OAM mode order of a beam reflected at the second sub-reflector.

The first sub-reflector may increase an OAM mode order of a beam reflected at the first sub-reflector, and the second sub-reflector may decrease an OAM mode order of a beam reflected at the second sub-reflector.

In order to achieve the objective of the present disclosure, a transceiving apparatus may comprise a radiator which emits a beam and includes a first mode conversion unit changing an orbital angular momentum (OAM) mode order of the emitted beam; a receiver which receives a beam and includes a second mode conversion unit changing an OAM mode order of the received beam; a sub-reflector provided to face the radiator and the receiver; and a main reflector provided to face the sub-reflector, wherein at least one of the main reflector and the sub-reflector changes the OAM mode orders of the beams so that a beam incident on the main reflector from an outside of the transceiving apparatus has a different OAM mode order with the beam emitted by the radiator after being reflected at the sub-reflector.

The first mode conversion unit may increase the OAM mode order of the beam emitted by the radiator, the sub-reflector may decrease the OAM mode order of the beam reflected at the sub-reflector, and the second mode conversion unit may increase the OAM mode order of the beam incident on the receiver.

The first mode conversion unit may decrease the OAM mode order of the beam emitted by the radiator, the sub-reflector may increase the OAM mode order of the beam reflected at the sub-reflector, and the second mode conversion unit may decrease the OAM mode order of the beam incident on the receiver.

The first mode conversion unit may increase the OAM mode order of the beam emitted by the radiator, the main reflector may decrease the OAM mode order of the beam reflected at the main reflector, and the second mode conversion unit may increase the OAM mode order of the beam incident on the receiver.

The first mode conversion unit may decrease the OAM mode order of the beam emitted by the radiator, the main reflector may increase the OAM mode order of the beam reflected at the main reflector, and the second mode conversion unit may decrease the OAM mode order of the beam incident on the receiver.

At least one of the main reflector and the sub-reflector may include at least one first patch element increasing an OAM mode order of a beam, and at least one second patch element decreasing an OAM mode order of a beam.

In order to achieve the objective of the present disclosure, a transceiving apparatus may comprise a radiator which emits a beam and includes a first mode conversion unit changing an orbital angular momentum (OAM) mode order of the emitted beam; a receiver which receives a beam and includes a second mode conversion unit changing an OAM mode order of the received beam; and a reflector provided to face the radiator and the receiver, wherein a beam incident on the reflector from an outside of the transceiving apparatus has a different OAM mode order with the beam emitted by the radiator after being reflected at the reflector.

The first mode conversion unit may increase the OAM mode order of the beam emitted by the radiator, the reflector may decrease the OAM mode order of the beam reflected at the reflector, and the second mode conversion unit may increase the OAM mode order of the beam incident on the receiver.

The first mode conversion unit may decrease the OAM mode order of the beam emitted by the radiator, the reflector may increase the OAM mode order of the beam reflected at the reflector, and the second mode conversion unit may decrease the OAM mode order of the beam incident on the receiver.

The reflector may include at least one first patch element increasing an OAM mode order of a beam reflected at the reflector, and at least one second patch element decreasing an OAM mode order of a beam reflected at the reflector.

The first mode conversion unit may increase the OAM mode order of the beam emitted by the radiator.

The first mode conversion unit may decrease the OAM mode order of the beam emitted by the radiator.

According to the above-described embodiments, orthogonality between beams can be ensured by using the OAM mode of the beams. Through this, in a full duplex environment, interference effect between the beams emitted from the radiator and the beams received from the outside can be remarkably reduced.

BRIEF DESCRIPTION OF DRAWINGS

Embodiments of the present disclosure will become more apparent by describing in detail embodiments of the present disclosure with reference to the accompanying drawings, in which.

DETAILED DESCRIPTION

Figure 1:
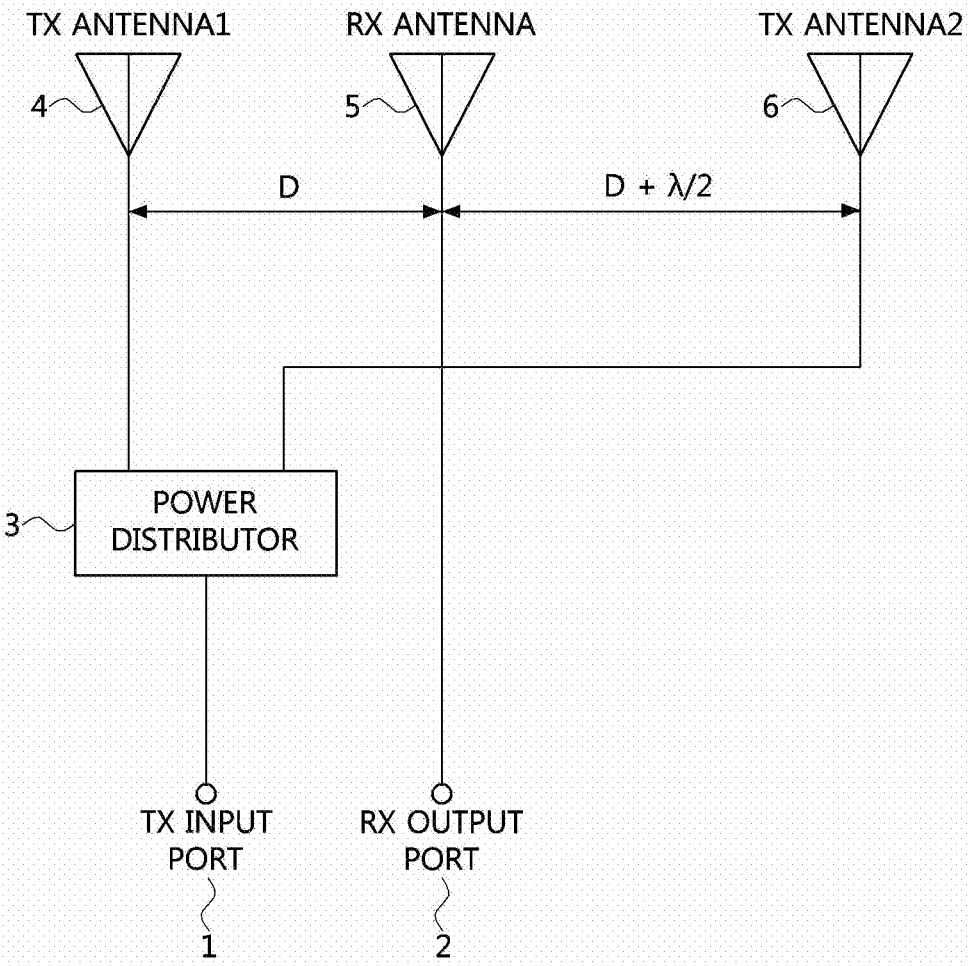
FIG. 1 is a conceptual diagram illustrating a conventional transceiver supporting a full duplex scheme.

Embodiments of the present disclosure are disclosed herein. However, specific structural and functional details disclosed herein are merely representative for purposes of describing embodiments of the present disclosure, however, embodiments of the present disclosure may be embodied in many alternate forms and should not be construed as limited to embodiments of the present disclosure set forth herein.

Accordingly, while the present disclosure is susceptible to various modifications and alternative forms, specific embodiments thereof are shown by way of example in the drawings and will herein be described in detail. It should be understood, however, that there is no intent to limit the present disclosure to the particular forms disclosed, but on the contrary, the present disclosure is to cover all modifications, equivalents, and alternatives falling within the spirit and scope of the present disclosure. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between," "adjacent" versus "directly adjacent," etc.).

The terminology used herein is for the purpose of describing particular embodiments only and is not intended to be limiting of the present disclosure. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present disclosure will be described in greater detail with reference to the accompanying drawings. In order to facilitate a thorough understanding of the present disclosure, the same reference numerals are used for the same constituent elements in the drawings and redundant explanations for the same constituent elements are omitted.

FIG. 1 is a conceptual diagram illustrating a conventional transceiver supporting a full duplex scheme.

Referring to FIG. 1, the transceiver may include a first transmission antenna 4, a second transmission antenna 6, and a reception antenna 5. The first transmit antenna 4 and the second transmit antenna 6 may emit respective beams. A signal applied through an input port 1 may be transmitted to a power distributor 3. The power distributor 3 may divide the signal applied through the input port 1 into two signals, and transmit the divided signals to the first transmission antenna 4 and the second transmission antenna 6. The beams emitted by the first transmit antenna 4 and the second transmit antenna 6 may be received at another transceiver.

The reception antenna 5 may receive beams transmitted by other transceivers. Also, a portion of the beams emitted from the first transmission antenna 4 and the second transmission antenna 6 may be incident on the reception antenna 5. The reception antenna 5 may be closer to the first transmitting antenna 4 and the second transmitting antenna 6 than other transceivers. Therefore, at the position where the reception antenna 5 is located, the intensity of the beams emitted from the first transmission antenna 4 and the second transmission antenna 6 may be relatively strong. Therefore, it is necessary to offset the beam emitted from the first transmission antenna 4 and the beam emitted from the second transmission antenna 6 at the position where the reception antenna 5 is located.

For example, when a distance between the first transmission antenna 4 and the reception antenna 5 is D, a distance between the second transmission antenna 6 and the reception antenna 5 may be $D+\lambda/2$. Here, $\lambda$ denotes a center wavelength of the beam emitted by the first transmission antenna 4 and the beam emitted by the second transmission antenna 6. If the first transmission antenna 4, the reception antenna 5, and the second transmission antenna 6 are arranged as illustrated in FIG. 1, the beam emitted from the first transmission antenna 4 and the beam emitted from the second transmission antenna 6 can be offset from each other at the position where the reception antenna 5 is located.

In the case of the transceiver illustrated in FIG. 1, two or more transmission antennas (e.g., 4 and 6) should be used, and the distance between the transmission antennas 4 and 6 and the reception antenna 5 may affect signal interferences. Therefore, there are many restrictions on the arrangement of antennas in the transceiver. Also, since the wavelength is short in the millimeter wave band, it may be difficult to arrange the antennas according to the desired requirements.

In the present disclosure, beams emitted from radiators of the transceiver and beams incident on a main reflector from the outside may have different orbital angular momentum (OAM) modes to be incident on a receiver, thereby alleviating interference effects between the beams. The OAM of the beam is a physical property of the beam determined by the shape of the beam's wavefront. Hereinafter, the OAM of the beam will be described.

Figure 2:
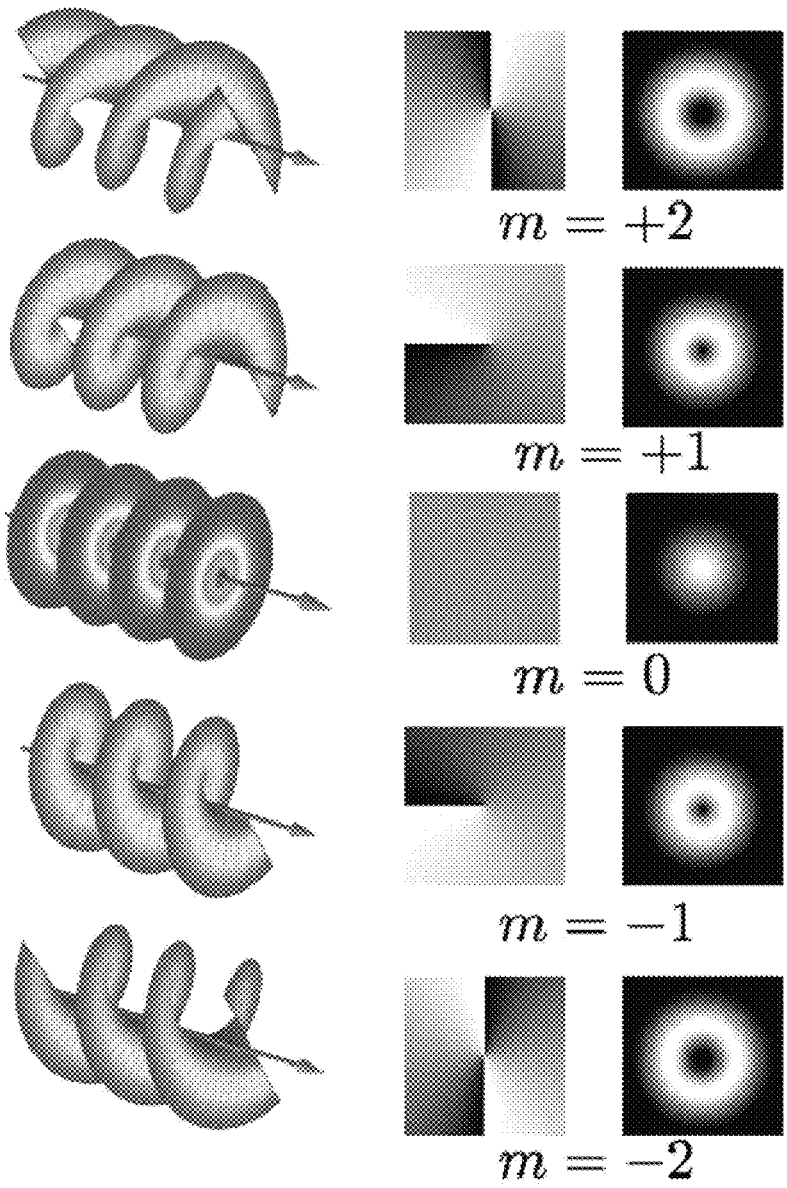
FIG. 2 is a conceptual diagram illustrating a beam wavefront for each OAM mode of a beam.

FIG. 2 is a conceptual diagram illustrating a beam wavefront for each OAM mode of a beam.

Referring to FIG. 2, when the OAM of the beam is changed, the wavefront of the beam may be changed. For example, in case of a $0^{th}$ order mode (i.e., m=0) in which the OAM of the beam is zero, the wavefront of the beam may be a plane perpendicular to a traveling direction of the beam. That is, the beam phase may be the same in a cross section of the beam. On the other hand, in case that the beam's OAM mode order is not zero, the wavefront of the beam may be a spiral that rotates with respect to the beam's traveling direction. Depending on the OAM mode order of the beam, the wavefront shape of the beam may be varied. Also, the rotational direction of the spiral shape may be different depending on a sign of the OAM mode order of the beam. For example, if the OAM mode order of the beam is a positive value (e.g., m=+1 or +2), the wavefront of the beam may rotate clockwise with respect to the traveling direction of the beam. When the OAM mode order of the beam is a negative value (e.g., m=−1 or −2), the wavefront of the beam may rotate counterclockwise with respect to the traveling direction of the beam.

Figure 3:
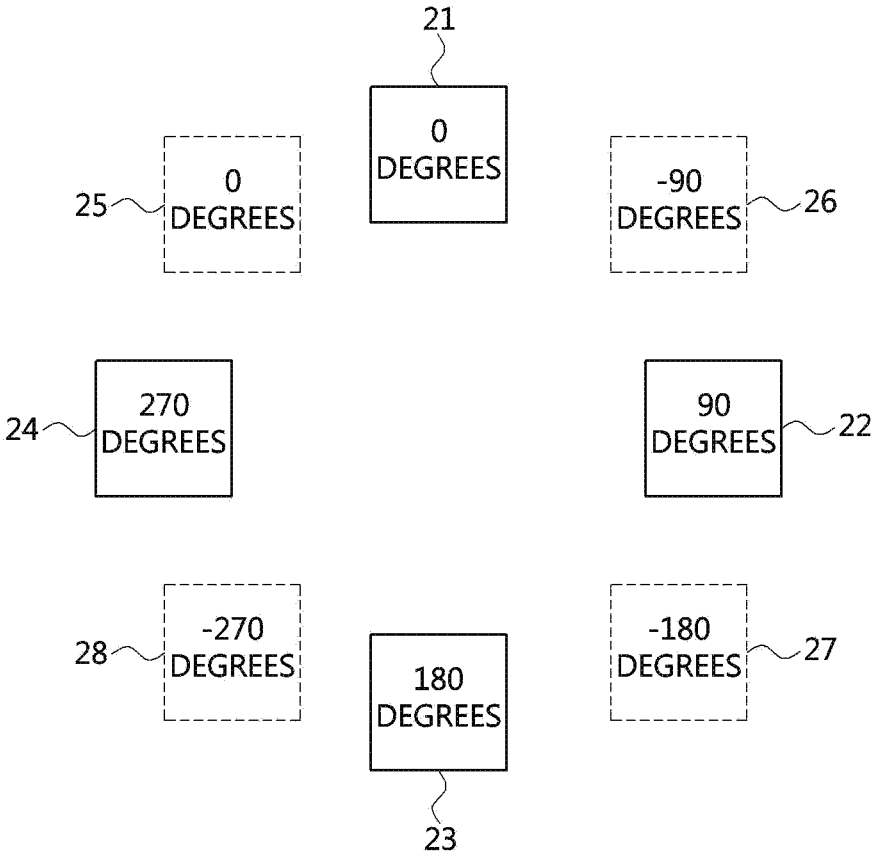
FIG. 3 is a conceptual diagram illustrating a method of configuring an OAM mode of a beam.

FIG. 3 is a conceptual diagram illustrating a method of configuring an OAM mode of a beam.

Referring to FIG. 3, the OAM mode of the beam may be configured by changing the phases of the beams emitted from sub-radiators. For example, by making the phases of the beams emitted from the sub-radiators 21, 22, 23, and 24 different by 90 degrees in the clockwise direction, a beam having a −1st order OAM mode may be formed. As another example, by making the phases of the beams emitted from the sub-radiators 25, 26, 27, and 28 different by 90 degrees in the counterclockwise direction, a beam having a +1st order OAM mode may be formed.

Figure 4:
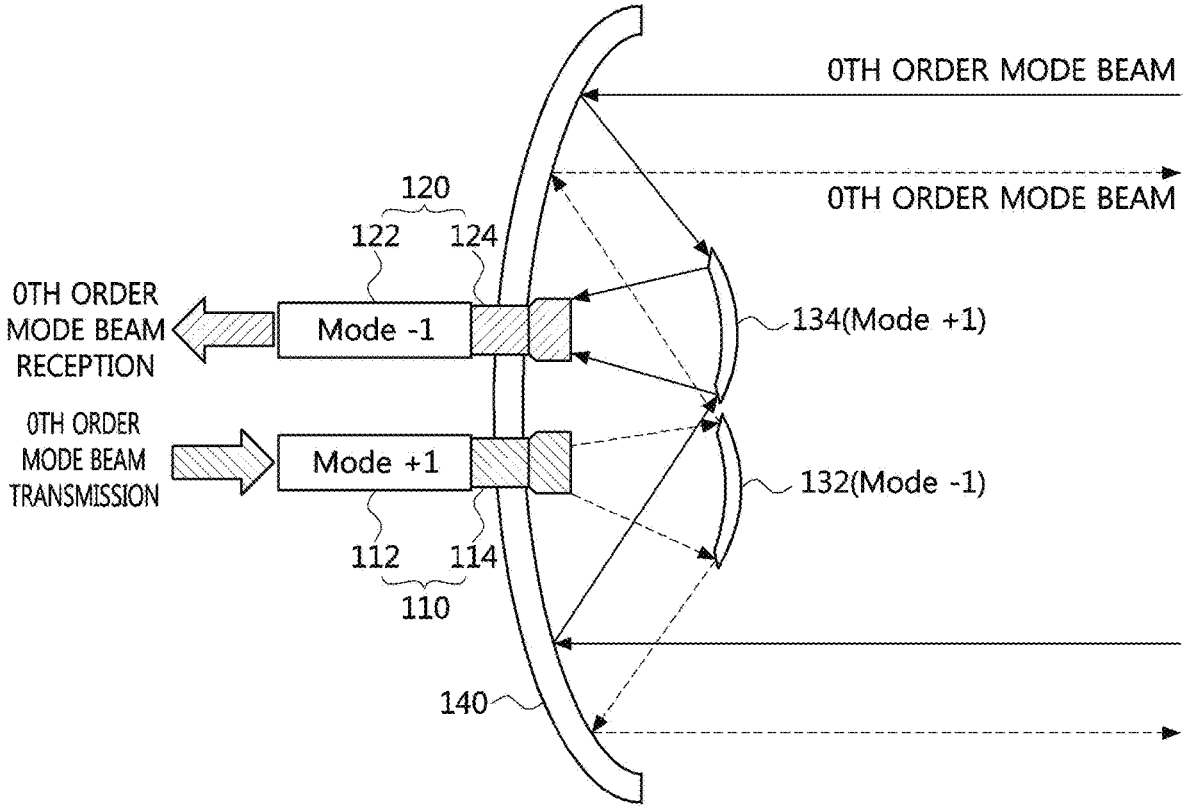
FIG. 4 is a conceptual diagram illustrating a transceiver according to a first embodiment of the present disclosure.

FIG. 4 is a conceptual diagram illustrating a transceiver according to a first embodiment of the present disclosure.

Referring to FIG. 4, the transceiver may include a radiator 110, a receiver 120, a first sub-reflector 132, a second sub-reflector 134, and a main reflector 140. In FIG. 4, shapes of the main reflector 140, the first sub-reflector 132, and the second sub-reflector 134 are curved, but the embodiment is not limited thereto. For example, when microstrip patches are arranged on the main reflector 140, the first sub-reflector 132, and the second sub-reflector 134 to adjust traveling directions of reflected beams, the main reflector 140, the first sub-reflector 132, and the second sub-reflector 134 may also be designed in a flat plate shape.

The radiator 110 may emit a beam. The radiator 110 may include a first mode conversion unit 112 and a first transmission unit 114. The first mode conversion unit 112 may receive a beam and change the OAM mode order of the beam. For example, the first mode conversion unit 112 may receive a 0th order mode beam. The 0th order mode beam may be a beam modulated to include data information transmitted by the transceiver. The first mode conversion unit 112 may change the 0th order mode beam to a +1st order mode.

In a first example, the first mode conversion unit 112 may comprise a spiral phase plate (SPP). The spiral phase plate is made of birefringent crystal, and steps may be formed on passing surfaces of the beam. The SPP may change the OAM mode order of the beam by changing the phase of the beam according to the passing position of the beam. In a second example, the first mode conversion unit 112 may include a pitch-fork hologram. The pitch-fork hologram may change the OAM mode order of the beam by changing the phase of the beam by interference of the beam. The embodiment of the first mode conversion unit 112 is not limited to the examples described above. For example, the first mode conversion unit 112 may include a Q-plate or a crystal mode converter or the like.

The beam whose OAM mode order is changed in the first mode conversion unit 112 may be emitted toward the first sub-reflector 132 via the first transmission unit 114. The beam emitted in the first transmission unit 114 may become the +1st order mode beam. The 1st order mode beam may be reflected at the first sub-reflector 132. The first sub-reflector 132 may change the OAM mode order of the beam reflected at the first sub-reflector 132. For example, steps may be formed on the reflecting surface of the first sub-reflector 132. The phase of the beam reflected at the first sub-reflector 132 may change as the steps are formed on the reflecting surface of the first sub-reflector 132. The OAM mode order of the beam reflected at the first sub-reflector 132 may be changed while the phase of the beam reflected at the first sub-reflector 132 is changed. As another example, the first sub-reflector 132 may comprise at least one patch element that changes the phase of the beam. The at least one patch element may change the phase of the beam reflected at the first sub-reflector 132 to change the OAM mode order of the beam.

The first sub-reflector 132 may change the OAM mode order of the beam reflected at the first sub-reflector 132 by −1. Accordingly, the 1st order mode beam emitted by the radiator 110 may become a 0th order mode beam after being reflected at the first sub-reflector 132. The beam may be reflected at the first sub-reflector 132 and then reflected at the main reflector 140 and transmitted to another transceiver. As a result, the transceiver can transmit the 0th order mode beam.

A beam transmitted from the outside to the transceiver may be incident on the main reflector 140. The beam reflected at the main reflector 140 may be reflected at the second sub-reflector 134 and then incident on the receiver 120. The second sub-reflector 134 may change the OAM mode order of the beam reflected at the second sub-reflector 134. For example, steps may be formed on the reflecting surface of the second sub reflector 134. As another example, the second sub-reflector 134 may include at least one patch element that changes the phase of the beam.

The second sub-reflector 134 may change the OAM mode order of the beam differently from the first sub-reflector 132. For example, the second sub-reflector 134 may change the OAM mode order of the beam reflected at the second sub-reflector 134 by +1. The 0th order mode beam reflected at the main reflector 140 may become a 1st order mode beam after being reflected at the second sub-reflector 134. The beam reflected at the second sub-reflector 134 may be incident on the receiver 120.

The receiver 120 may include a second beam transfer unit 124 and a second mode conversion unit 122. The second beam transfer unit 124 may transfer the beam incident on the second beam transfer unit 124 to the second mode conversion unit 122. The second mode conversion unit 122 may include a SPP or a pitch-fork hologram. The embodiment of the second mode conversion unit 122 is not limited to the above-described examples. For example, the second mode conversion unit 122 may include a Q-plate or a crystal mode converter or the like.

The second mode conversion unit 122 may change the OAM mode order of the beam transferred to the second mode conversion unit 122 by −1. For example, the +1st order mode beam reflected at the second sub-reflector 134 may become a 0th order mode beam at the second mode conversion unit 122 via the second beam transfer unit 124. That is, the 0th order mode beam incident on the main reflector 140 of the transceiver may be returned to the 0th order mode beam from the receiver 120 again. The receiver can demodulate the 0th order mode beam and verify the data.

Figure 5:
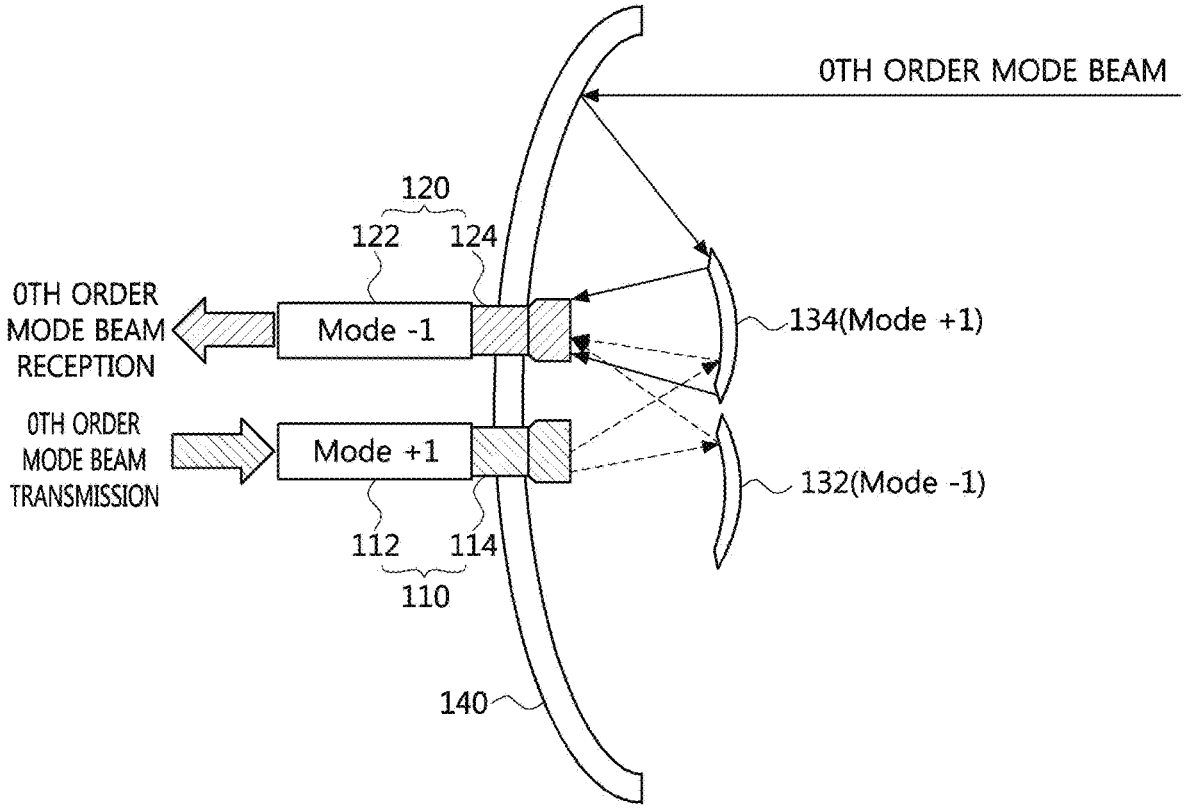
FIG. 5 is a conceptual diagram explaining a principle of suppressing interference effects in the transceiver shown in FIG. 4.

FIG. 5 is a conceptual diagram explaining a principle of suppressing interference effects in the transceiver shown in FIG. 4.

Referring to FIG. 5, the beam emitted from the radiator 110 and the beam incident from the outside to the main reflector 140 may be incident on the receiver 120 with different OAMs. For example, the +1st order mode beam emitted by the radiator 110 may be reflected at the first sub-reflector 132 and then enter the receiver 120 as the 0th order mode beam. The +1st order mode beam emitted by the radiator 110 may be reflected at the second sub-reflector 134 and then enter the receiver 120 as a +2st order mode beam. On the other hand, the 0th order mode beam incident from the outside to the main reflector 140 may be reflected at the second sub-reflector 134 and then enter the receiver 120 as a +1st order mode beam.

When the beam emitted from the radiator 110 and the beam incident from the outside to the main reflector 140 are incident on the receiver 120 with different OAM modes, orthogonality between the beams may be ensured. The transceiver can selectively detect only the 0th order mode beam among the beams that have passed through the second mode conversion unit 122. Therefore, even if the beam received from the outside and the beam emitted from the radiator 110 enter the receiver 120 together, the interference effect between the beams can be reduced by utilizing the orthogonality between the beams.

Although FIGS. 4 and 5 show an example in which the OAM mode orders of the beams are changed, the embodiment is not limited thereto. The OAM mode order of the beam may be changed in a different manner. For example, the first mode conversion unit 112 of the radiator 110 may increase the OAM mode order of the beam by n. Here, n is an arbitrary natural number. Then, the first sub-reflector 132 may decrease the OAM mode order of the beam by n. Therefore, the beam emitted from the radiator 110 may have the same OAM mode order as being incident on the first mode conversion unit 112 after being reflected at the main reflector 140.

On the other hand, the second sub-reflector 134 may increase the OAM mode order of the beam by m. Here, m is an arbitrary natural number. The second mode conversion unit 122 of the receiver 120 may decrease the OAM mode order of the beam by m. Thus, the beam incident from the outside to the main reflector 130 may have the same OAM mode order as that before being reflected at the second sub-reflector 132 after passing through the second mode conversion unit 122.

FIGS. 4 and 5 illustratively show that the first sub-reflector 132 decreases the OAM mode order and the second sub-reflector 134 increases the OAM mode order, but vice versa.

Figure 6:
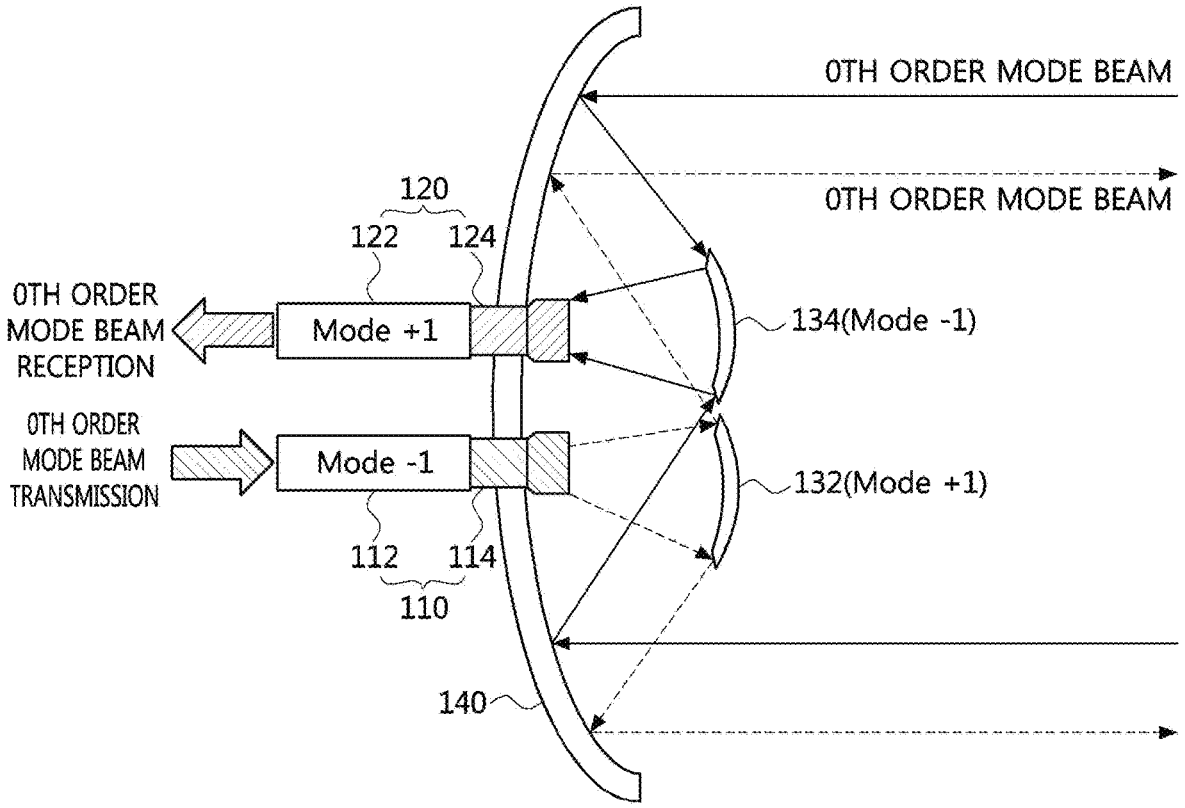
FIG. 6 is a conceptual diagram illustrating a transceiver according to a second embodiment of the present disclosure.

FIG. 6 is a conceptual diagram illustrating a transceiver according to a second embodiment of the present disclosure. In the following description of the embodiment of FIG. 6, description redundant with that of FIG. 4 will be omitted.

Referring to FIG. 6, the first mode conversion unit 112 may decrease the OAM mode order of the beam. The first mode conversion unit 112 may change the OAM mode order of the beam by −1. When a 0th order mode beam is input to the first mode conversion unit 112, the radiator 110 may emit a −1st order mode beam. The first sub-reflector 132 may increase the OAM mode order of the beam. The first sub-reflector 132 may change the OAM mode order of the beam by +1. The −1st order mode beam, which is emitted by the radiator 110, may become a 0th order mode beam after being reflected at the first sub-reflector 132. As a result, the transceiver can transmit the 0th order mode beam to the outside.

The second mode conversion unit 122 may increase the OAM mode order of the beam. The second mode conversion unit 122 may change the OAM mode order of the beam by +1. The second sub-reflector 134 may decrease the OAM mode order of the beam. The second sub-reflector 134 may change the OAM mode order of the beam by −1. The 0th order mode beam incident from the outside to the main reflector 140 may be reflected at the second sub-reflector 134 to become a −1st order mode beam. The +1st order mode beam incident on the receiver 120 may pass through the second mode conversion unit 122 and become a 0th order mode beam.

The example of mode conversions shown in FIG. 6 is merely an example, and the embodiment is not limited thereto. The OAM mode order of the beam may be changed in a different manner. For example, the first mode conversion unit 112 of the radiator 110 may reduce the beam's OAM mode order by n. Here, n is an arbitrary natural number. The first sub-reflector 132 may increase the OAM mode order of the beam by n. Therefore, the beam emitted from the radiator 110 may have the same OAM mode order as reflected at the main reflector 140 and then incident on the first mode conversion unit 112.

On the other hand, the second sub-reflector 134 may decrease the OAM mode order of the beam by m. Here, m is an arbitrary natural number. The second mode conversion unit 122 of the receiver 120 may increase the OAM mode order of the beam by m. Thus, the beam incident from the outside to the main reflector 130 may have the same OAM mode order as that before being reflected at the second sub-reflector 132 after passing through the second mode conversion unit 122.

Figure 7:
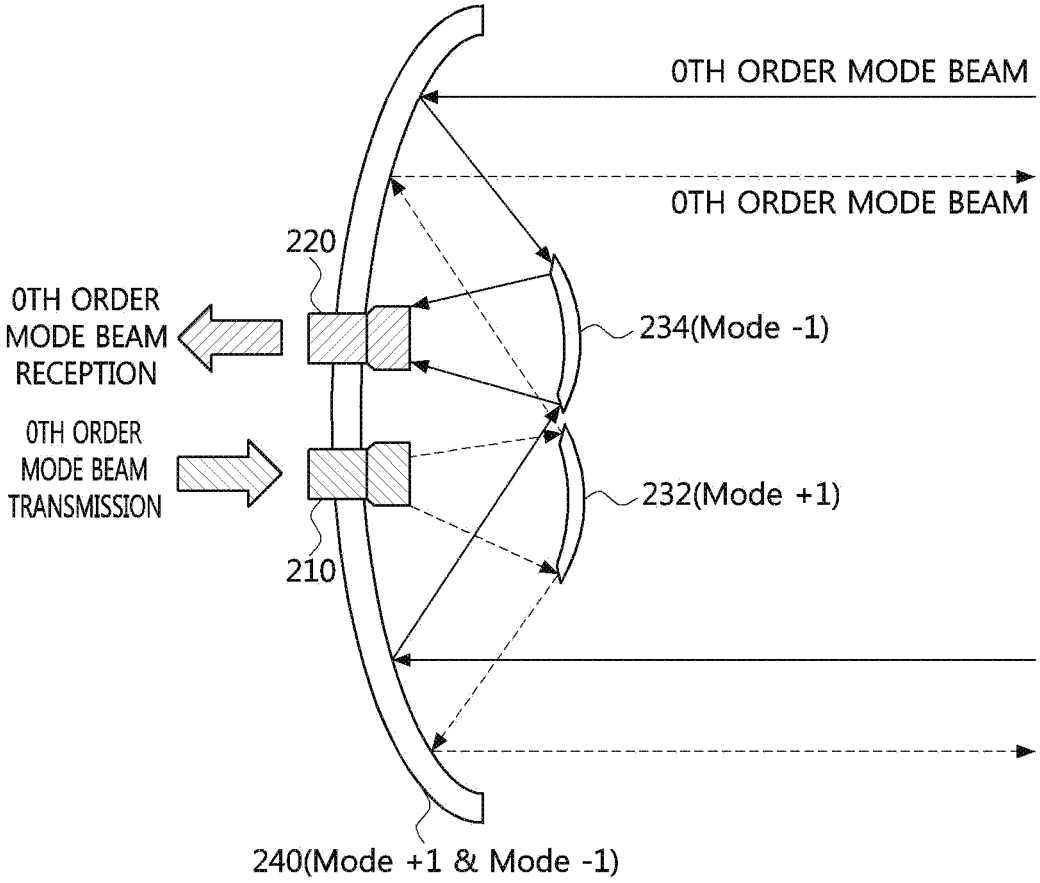
FIG. 7 is a conceptual diagram illustrating a transceiver according to a third embodiment of the present disclosure.

FIG. 7 is a conceptual diagram illustrating a transceiver according to a third embodiment of the present disclosure.

Referring to FIG. 7, the main reflector 240 may include at least one first patch element that increases the OAM mode order of the beam and at least one second patch element that reduces the OAM mode order of the beam. The main reflector 240 includes a plurality of first patch elements and a plurality of second patch elements. The first patch elements and the second patch elements may be arranged on the reflecting surface of the main reflector 240. Accordingly, OAM mode orders of some of the beams reflected at the main reflector 240 may be increased, and those of the other beams may be decreased.

The first sub-reflector 232 may increase the OAM mode order of the beam reflected at the first sub-reflector 232. For example, the first sub-reflector 232 may change the OAM mode order of the beam by +1. The 0th order mode beam emitted by the emitter 210 may become a 1st order mode beam after being reflected at the first sub-reflector 232. The 1st order mode beam reflected at the first sub-reflector 232 may be reflected at the main reflector 240, and then a portion of the beam may be the 0th order mode beam and the other portion may be the 2nd order mode beam. In a side of receiving the signal transmitted by the transceiver, the 0th order mode beam can be selectively detected and the data transmitted by the transceiver can be demodulated.

The second sub-reflector 234 may decrease the OAM mode order of the beam reflected at the second sub-reflector 234. For example, the second sub-reflector 234 may change the OAM mode order of the beam by −1. A portion of the 0th order mode beam incident on the main reflector 240 may become a 1st order mode beam, and the other portion of it may be a −1st order mode beam. The 1st order mode beam may become a 0th order mode beam after being reflected at the secondary sub-reflector 234. The −1st order mode beam may be a −2nd order mode beam after being reflected at the second sub reflector 234. The transceiver can selectively detect the 0th order mode beam incident on the receiver 220 and demodulate data received from the outside.

A portion of the beam emitted by the radiator 210 may be reflected at the first sub-reflector 232 and then be incident on the receiver 220 as a 1st order mode beam. The other portion of the beam emitted by the radiator 210 may be reflected at the second sub-reflector 234 and then become a −1st mode beam, and may be incident on the receiver 220. In any case, since the beam emitted by the radiator 210 is incident on the receiver 220 in a mode different from the 0th order mode beam, the interference effect of the beams can be reduced.

The example of mode conversions shown in FIG. 7 is merely an example, and the embodiment is not limited thereto. The OAM mode order of the beam may be changed in a different manner. For example, the main reflector 240 may include at least one first patch element for increasing the beam's OAM mode order by n and at least one second patch element for reducing the beam's OAM mode order by m. Here, n and m are arbitrary natural numbers. The first sub-reflector 232 may increase the OAM mode order of the beam by m. The second sub-reflector 234 may reduce the OAM mode order of the beam by n.

Although FIG. 7 shows an example in which the first sub-reflector 232 increases the OAM mode order of the beam and the second sub-reflector 234 decreases the OAM mode order of the beam, the embodiment is not limited thereto. The opposite is also possible.

Figure 8:
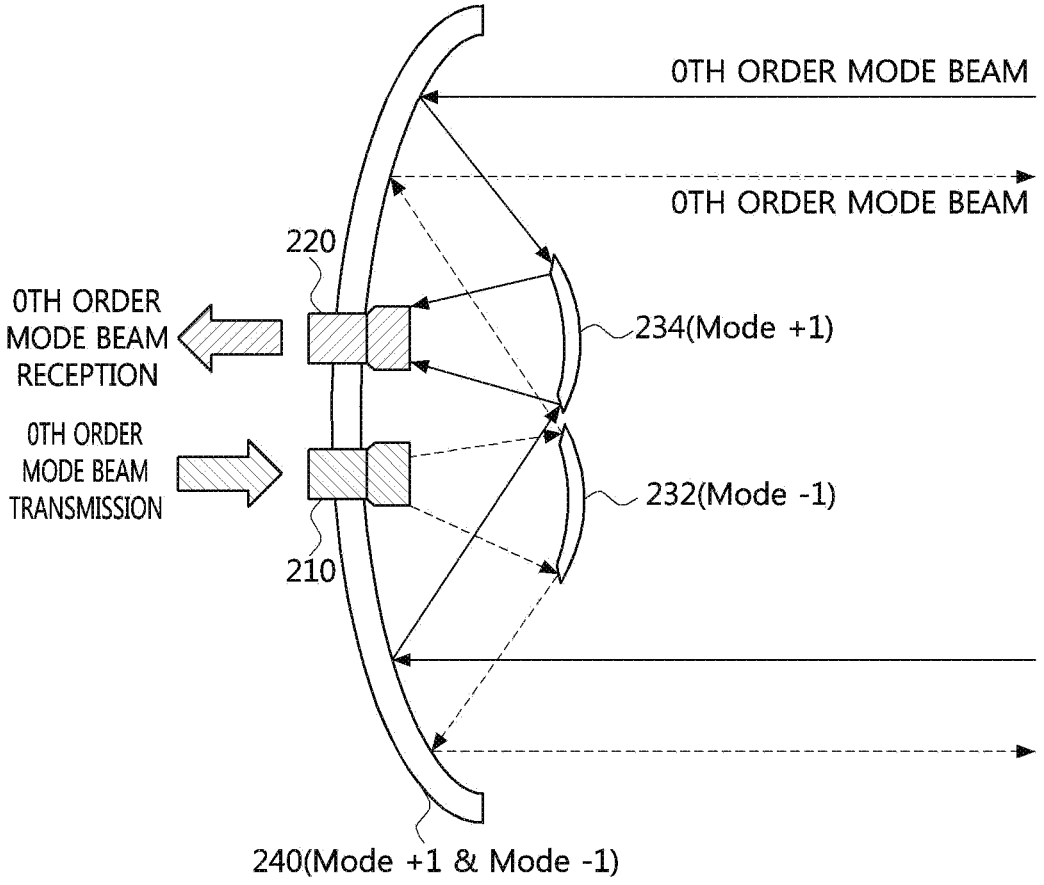
FIG. 8 is a conceptual diagram illustrating a transceiver according to a fourth embodiment of the present disclosure.

FIG. 8 is a conceptual diagram illustrating a transceiver according to a fourth embodiment of the present disclosure. In the following description of the embodiment of FIG. 8, description redundant with that of FIG. 7 will be omitted.

The first sub-reflector 232 may decrease the OAM mode order of the beam reflected at the first sub-reflector 232. For example, the first sub-reflector 232 may change the OAM mode order of the beam by −1. The 0th order mode beam emitted by the radiator 210 may become a −1st order mode beam after being reflected at the first sub-reflector 232. The −1st order mode beam reflected at the first sub-reflector 232 may be reflected at the main reflector 240, and then a portion of it may become a 0th order mode beam and the other portion may become a −2nd order mode beam. In a side of receiving the signal transmitted by the transceiver, the 0th order mode beam can be selectively detected and the data transmitted by the transceiver can be demodulated.

The second sub-reflector 234 may increase the OAM mode order of the beam reflected at second sub-reflector 234. For example, the second sub-reflector 234 may change the OAM mode order of the beam by +1. Some of the 0th order mode beam incident on the main reflector 240 may be a 1st order mode beam, and the other of it may be a −1st order mode beam. The 1st order mode beam may be a 2nd order mode beam after being reflected at the secondary sub-reflector 234. The −1st order mode beam may be the 0th order mode beam after being reflected at the second sub reflector 234. The transceiver can selectively detect the 0th order mode beam incident on the receiver 220 and demodulate data received from the outside.

Some of the beam emitted by the radiator 210 may be reflected at the first sub-reflector 232 and then become a −1st order mode beam and be incident on the receiver 220. The other portion of the beam emitted by the radiator 210 may be reflected at the second sub-reflector 234 and then become a 1st order mode beam and enter the receiver 220. In any case, since the beam emitted by the radiator 210 is incident on the receiver 220 in a mode different from the 0th order mode, the interference effect of the beams can be reduced.

The example of the mode conversions shown in FIG. 8 is merely an example, and the embodiment is not limited thereto. The OAM mode order of the beam may be changed in a different manner. For example, the main reflector 240 may include a first patch element for increasing the beam's OAM mode order by n and a second patch element for reducing the beam's OAM mode order by m. Here, n and m are arbitrary natural numbers. The first sub-reflector 232 may reduce the OAM mode order of the beam by n. The second sub-reflector 234 may increase the OAM mode order of the beam by m.

Figure 9:
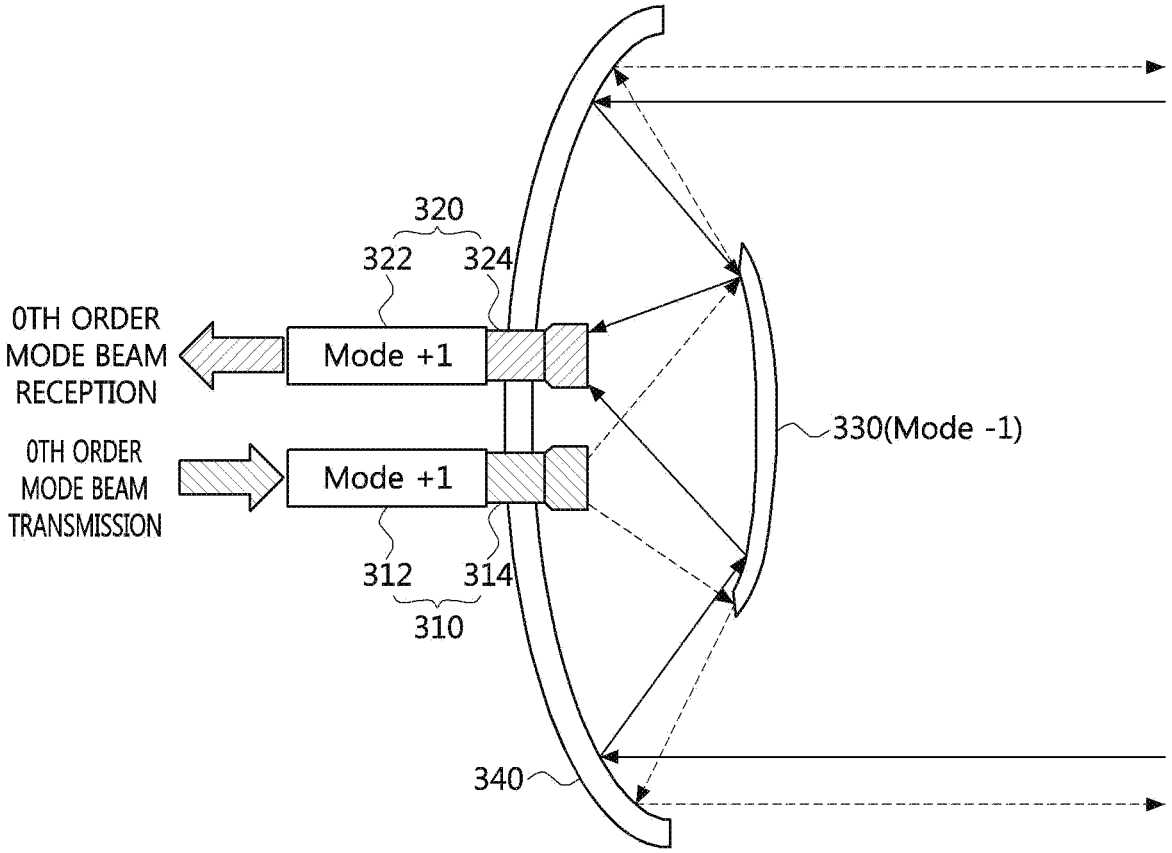
FIG. 9 is a conceptual diagram illustrating a transceiver according to a fifth embodiment of the present disclosure.

FIG. 9 is a conceptual diagram illustrating a transceiver according to a fifth embodiment of the present disclosure.

Referring to FIG. 9, the transceiver may include a radiator 310, a receiver 320, a sub-reflector 330, and a main reflector 340. The radiator 310 may include a first mode conversion unit 312 and a first beam transfer unit 314. The receiver 320 may include a second mode conversion unit 322 and a second beam transfer unit 324. The sub-reflector 330 may face the radiator 310 and the receiver 320. The main reflector 340 may be opposed to the sub-reflector 330.

The first mode conversion unit 312 may increase the OAM mode order of the beam emitted from the radiator 310. For example, the first mode conversion unit 312 may change the OAM mode order of the beam by +1. Thus, the radiator 310 may emit a 1st order mode beam. The beam emitted from the radiator 310 may be reflected at the sub-reflector 330.

The sub-reflector 330 may decrease the OAM mode order of the beam reflected at the sub-reflector 330. For example, the sub-reflector 330 may change the OAM mode order of the beam by −1. The 1st order mode beam emitted by the radiator 310 may become a 0th order mode beam after being reflected at the sub-reflector 330. The beam emitted from the radiator 310 may be reflected at the sub-reflector 330 and then reflected at the main reflector 340 to be transmitted to the outside. As a result, the transceiver can transmit the 0th order mode beam to the outside.

The beam transmitted from the outside of the transceiver may be incident on the main reflector 340. The beam reflected at the main reflector 340 may be reflected at the sub-reflector 330. The sub-reflector 330 may reduce the OAM mode order of the beam. For example, the beam incident on the main reflector 340 may become a −1st order mode beam after being reflected at the sub-reflector 330. The −1st order mode beam reflected at the sub-reflector 330 may be incident on the receiver 320. The second mode conversion unit 322 of the receiver 320 may increase the OAM mode order of the beam. For example, the second mode conversion unit 322 may change the OAM mode order of the beam incident on the receiver 320 by +1. As a result, the 0th order mode beam incident on the main reflector 340 may be reflected at the sub-reflector 330 and then become the 0th order mode beam again through the second mode conversion unit 322. The transceiver can selectively detect the 0th order mode beam and demodulate data received from the outside.

A portion of the beam emitted from the radiator 310 may be incident on the receiver 320. For example, a portion of the 1st order mode beams emitted by the radiator 310 may be reflected at the sub-reflector 330 and then be incident on the receiver 320 as a 0th order mode beam. However, the beam incident on the main reflector 340 from the outside may be incident on the receiver 320 as a −1st order mode beam. Therefore, orthogonality between the beams can be ensured. The transceiver can selectively detect only the 0th order mode beam among the beams that have passed through the second mode conversion unit 322. Even if the beam received from the outside and the beam emitted from the radiator 310 enter the receiver 320 together, the interference effect between the beams can be reduced by utilizing the orthogonality between the beams.

Although FIG. 9 shows an example in which the sub-reflector 330 reduces the OAM mode order of the beam, the embodiment is not limited thereto.

Figure 10:
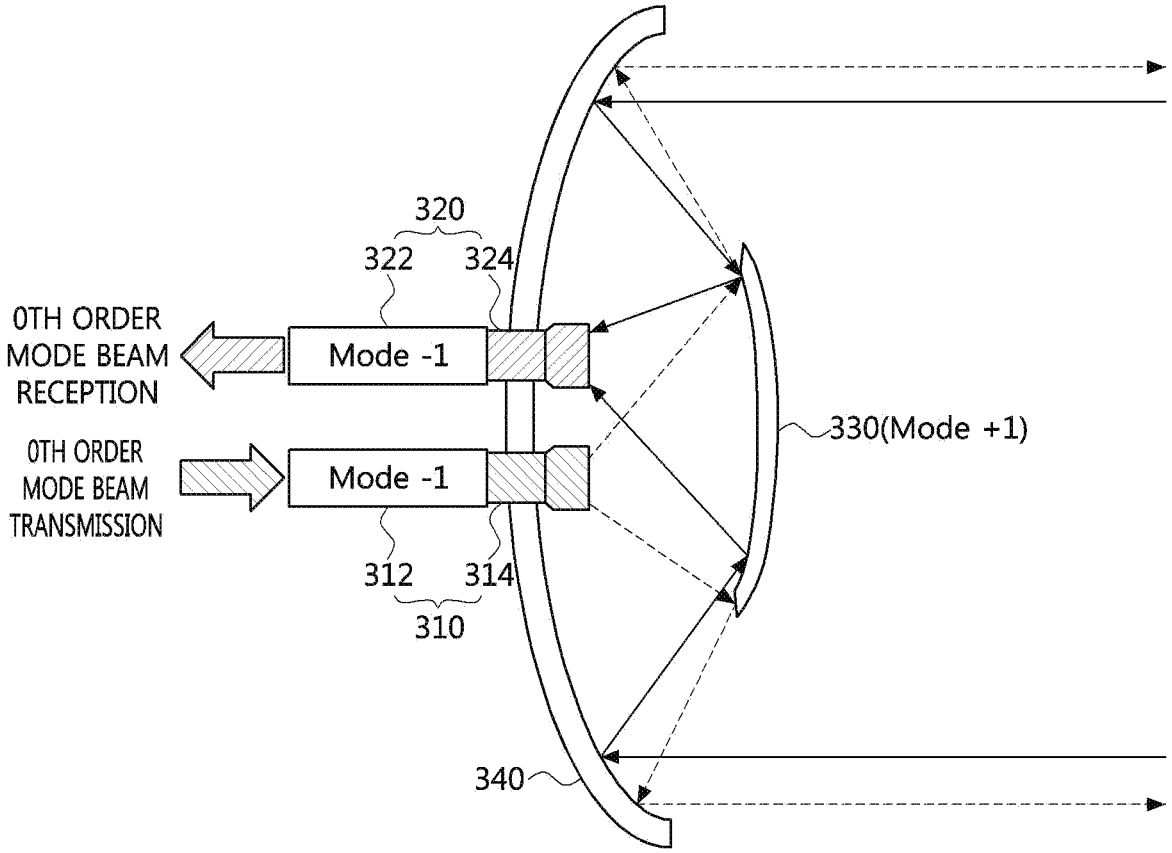
FIG. 10 is a conceptual diagram illustrating a transceiver according to a sixth embodiment of the present disclosure.

FIG. 10 is a conceptual diagram illustrating a transceiver according to a sixth embodiment of the present disclosure. In the following description of the embodiment of FIG. 10, description redundant with that of FIG. 9 will be omitted.

Referring to FIG. 10, the first mode conversion unit 312 may decrease the OAM mode order of the beam emitted from the radiator 310. For example, the first mode conversion unit 312 may change the OAM mode order of the beam by −1. The radiator 310 may emit a −1st order mode beam. The sub-reflector 330 may increase the OAM mode order of the beam reflected at the sub-reflector 330. The sub-reflector 330 may change the OAM mode order of the beam by +1. The −1st order mode beam emitted by the radiator 310 may become a 0th order mode beam after being reflected at the sub-reflector 330. The 0th order mode beam reflected at the sub-reflector 330 may be reflected at the main reflector 340 and then transmitted to the outside.

A beam incident from the outside to the main reflector 340 may be reflected at the sub-reflector 330 and then become a 1st order mode beam. The 1st order mode beam reflected at the sub-reflector 330 may be incident on the receiver 320. The second mode conversion unit 322 may reduce the OAM mode order of the beam. For example, the second mode conversion unit 322 may change the OAM mode order of the beam incident on the receiver 320 by −1. The 1st order mode beam incident on the receiver 320 may become a 0th order mode beam after passing through the second mode conversion unit 322. The transceiver can selectively demodulate the data received from the outside by selectively detecting the 0th order mode beam.

A portion of the −1st order mode beam emitted by the radiator 310 may be reflected at the sub-reflector 330 and then be incident on the receiver 320 as a 0th order mode beam. However, the beam incident on the main reflector 340 from the outside may be incident on the receiver 320 as a 1st order mode beam. Therefore, orthogonality between the beams can be ensured. The transceiver can selectively detect only the 0th order mode beam among the beams that have passed through the second mode conversion unit 322.

In FIGS. 9 and 10, the OAM mode order of the beam is changed in the sub-reflector 330 by way of example. However, the embodiment is not limited thereto. For example, the OAM mode order of the beam may be changed at the main reflector 340. As another example, the OAM mode order of the beam may be changed at both of the sub-reflector 330 and the main reflector 340.

Figure 11:
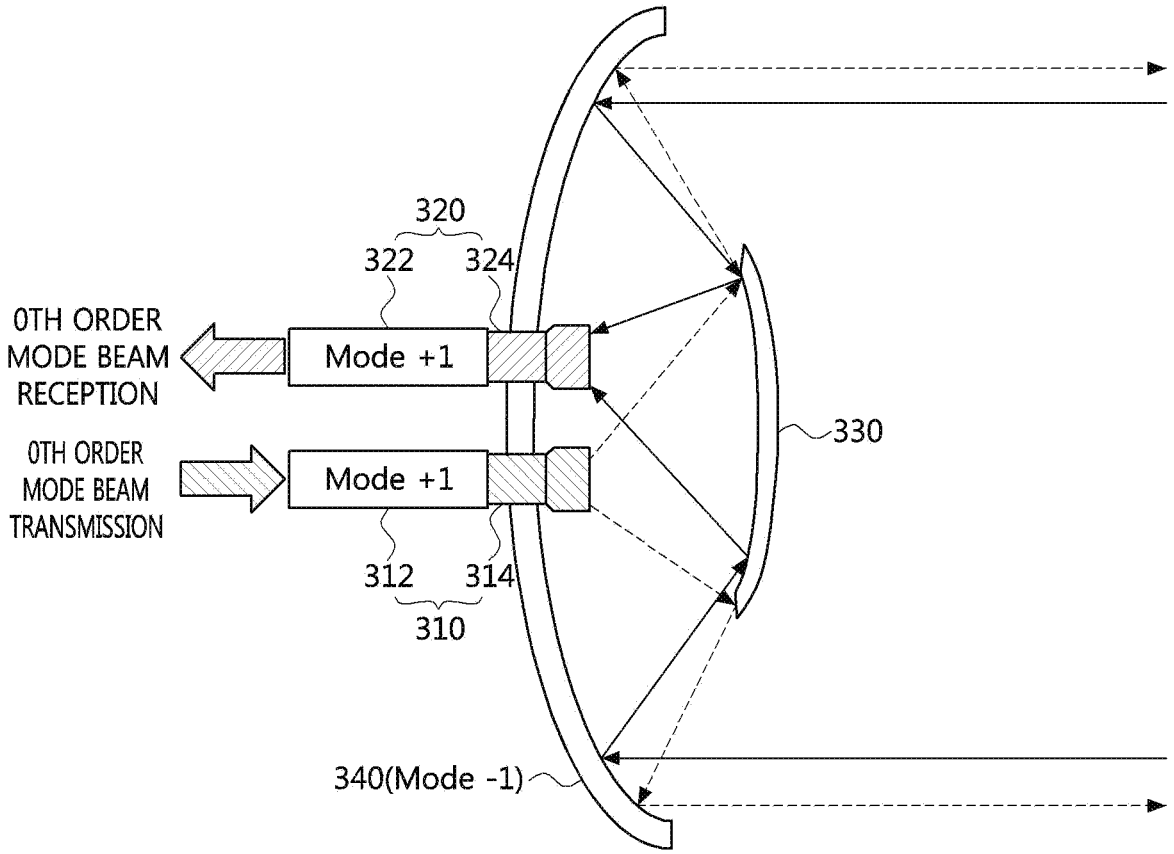
FIG. 11 is a conceptual diagram illustrating a transceiver according to a seventh embodiment of the present disclosure.

FIG. 11 is a conceptual diagram illustrating a transceiver according to a seventh embodiment of the present disclosure. In the following description of the embodiment of FIG. 11, description redundant with that of FIG. 9 will be omitted.

Referring to FIG. 11, the first mode conversion unit 312 may increase the OAM mode order of the beam emitted from the radiator 310. For example, the first mode conversion unit 312 may change the OAM mode order of the beam by +1. The radiator 310 may emit a 1st order mode beam. The main reflector 340 may reduce the OAM mode order of the beam reflected at the main reflector 340. The main reflector 340 may change the OAM mode order of the beam by −1. The 1st order mode beam emitted by the radiator 310 may be reflected at the sub-reflector 330 and then reflected at the main reflector 340 to be a 0th order mode beam.

A 0th order mode beam incident on the main reflector 340 from the outside may become a −1st order mode beam after being reflected at the main reflector 340. The −1st order mode beam reflected at the main reflector 340 may be reflected at the sub-reflector 330 and then be incident on the receiver 320. The second mode conversion unit 322 may increase the OAM mode order of the beam. For example, the second mode conversion unit 322 may change the OAM mode order of the beam incident on the receiver 320 by +1. The −1st order mode beam incident on the receiver 320 may be a 0th order mode beam while passing through the second mode conversion unit 322. The transceiver can selectively demodulate the data received from the outside by selectively detecting the 0th order mode beam.

A portion of the 1st order mode beam emitted by the radiator 310 may be reflected at the sub-reflector 330 and then incident on the receiver 320. However, the beam incident on the main reflector 340 from the outside may be incident on the receiver 320 as a −1st order mode beam. Therefore, orthogonality between the beams can be ensured. The transceiver can selectively detect only the 0th order mode beam among the beams that have passed through the second mode conversion unit 322.

Figure 12:
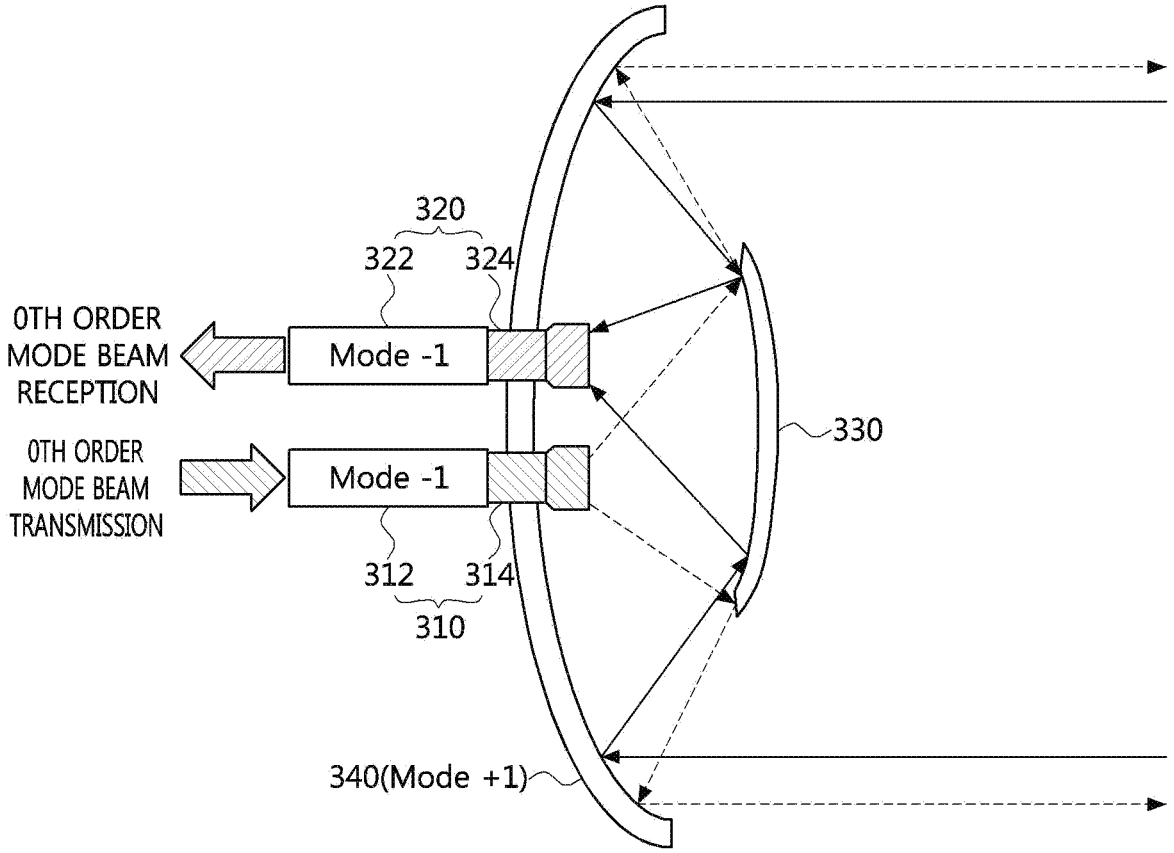
FIG. 12 is a conceptual diagram illustrating a transceiver according to an eighth embodiment of the present disclosure.

FIG. 12 is a conceptual diagram illustrating a transceiver according to an eighth embodiment of the present disclosure. In the following description of the embodiment of FIG. 12, description redundant with that of FIG. 11 will be omitted.

Referring to FIG. 12, the first mode conversion unit 312 may decrease the OAM mode order of the beam emitted from the radiator 310. For example, the first mode conversion unit 312 may change the OAM mode order of the beam by −1. The radiator 310 may emit a −1st order mode beam. The main reflector 340 may increase the OAM mode order of the beam reflected at the main reflector 340. The main reflector 340 may change the OAM mode order of the beam by +1. The −1st order mode beam emitted from the radiator 310 may be reflected at the sub-reflector 330 and then reflected at the main reflector 340 to be a 0th order mode beam.

A 0th order mode beam incident from the outside to the main reflector 340 may become a 1st order mode beam after being reflected at the main reflector 340. The 1st order mode beam reflected at the main reflector 340 may be reflected at the sub-reflector 330 and then incident on the receiver 320. The second mode conversion unit 322 may reduce the OAM mode order of the beam. For example, the second mode conversion unit 322 may change the OAM mode order of the beam incident on the receiver 320 by −1. The 1st order mode beam incident on the receiver 320 may become a 0th order mode beam after passing through the second mode conversion unit 322. The transceiver can selectively demodulate the data received from the outside by selectively detecting the 0th order mode beam.

A portion of the −1st order mode beam emitted by the radiator 310 may be reflected at the sub-reflector 330 and then incident on the receiver 320. However, the beam incident on the main reflector 340 from the outside may be incident on the receiver 320 as a 1st order mode beam. Therefore, orthogonality between the beams can be ensured. The transceiver can selectively detect only the 0th order mode beam among the beams that have passed through the second mode conversion unit 322.

Figure 13:
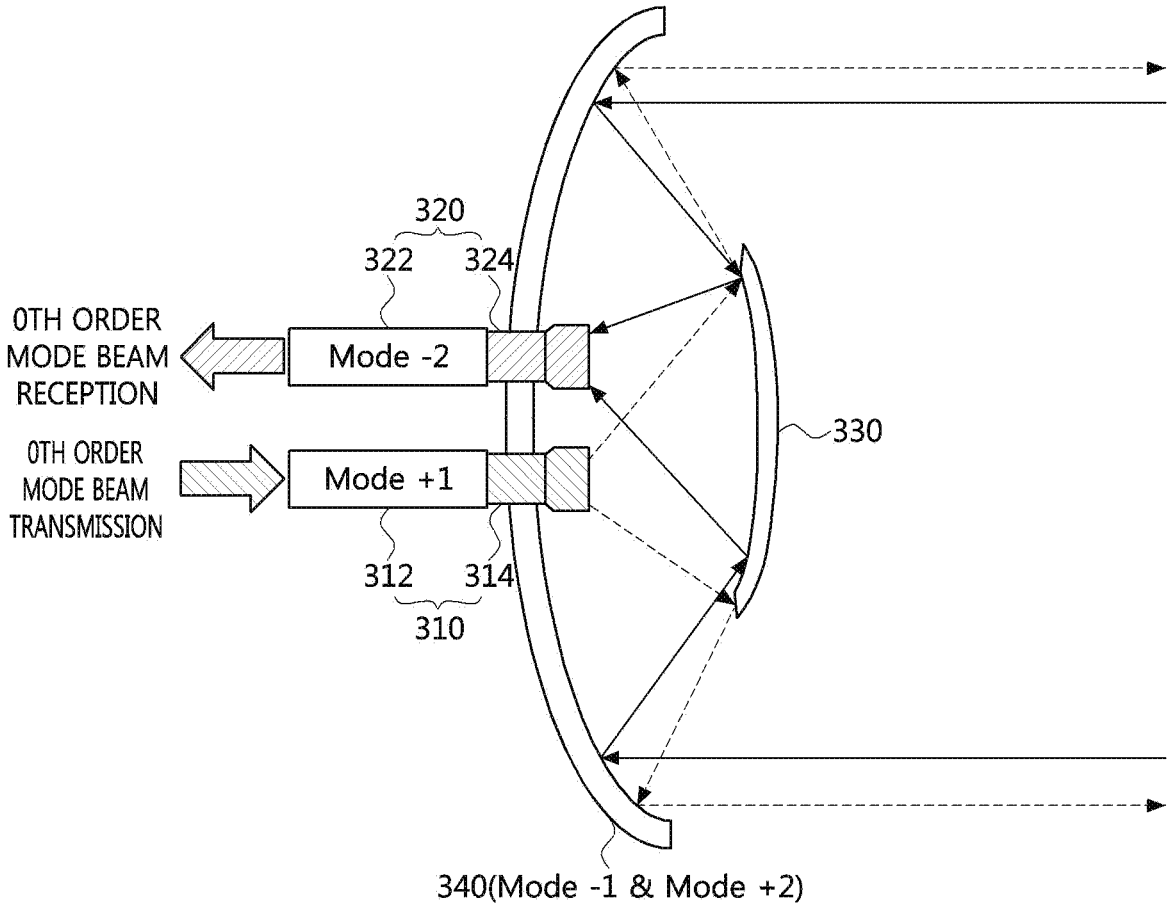
FIG. 13 is a conceptual diagram illustrating a transceiver according to a ninth embodiment of the present disclosure.

FIG. 13 is a conceptual diagram illustrating a transceiver according to a ninth embodiment of the present disclosure.

Referring to FIG. 13, the first mode conversion unit 312 may increase the OAM mode order of the beam emitted from the radiator 310. For example, the first mode conversion unit 312 may change the OAM mode order of the beam by +1. The radiator 310 may emit a 1st order mode beam.

The main reflector 340 may include a first patch element that increases the OAM mode order of the beam and a secondary patch element that reduces the OAM mode order of the beam. The main reflector 340 may include a plurality of first patch elements and a plurality of second patch elements. The first patch elements and the second patch elements may be arranged on the reflecting surface of the main reflector 340. The first patch elements may change the OAM mode order of the beam by +2, and the second patch elements may change the OAM mode order of the beam by −1. Therefore, OAM mode orders of some of the beams reflected at the main reflector 340 may be increased, and OAM mode orders of the other of the beams may be decreased.

The 1st order mode beam emitted by the radiator 310 may be reflected at the sub-reflector 330 and then reflected at the main reflector 340. A portion of the 1st order mode beam may be reflected at the main reflector 340 and then become a 0th order mode beam while the other becomes a 3rd order mode beam. In a side of receiving a signal transmitted by the transceiver, the 0th order mode beam can be selectively detected and the data transmitted by the transceiver can be demodulated.

A portion of the 0th order mode beam incident on the main reflector 340 from the outside may become a −1st order mode beam, and the other may be a 2nd order mode beam. The second mode conversion unit 322 of the receiver 320 may reduce the OAM mode order of the beam incident on the receiver 320. The second mode conversion unit 322 may change the OAM mode order of the beam by −2. Only the 2nd order mode beam among the beams incident on the receiver 320 may become 0th order mode beams after passing through the second mode conversion unit 322. Therefore, the transceiver can selectively demodulate the data received from the outside by selectively detecting the 0th order mode beam.

Figure 14:
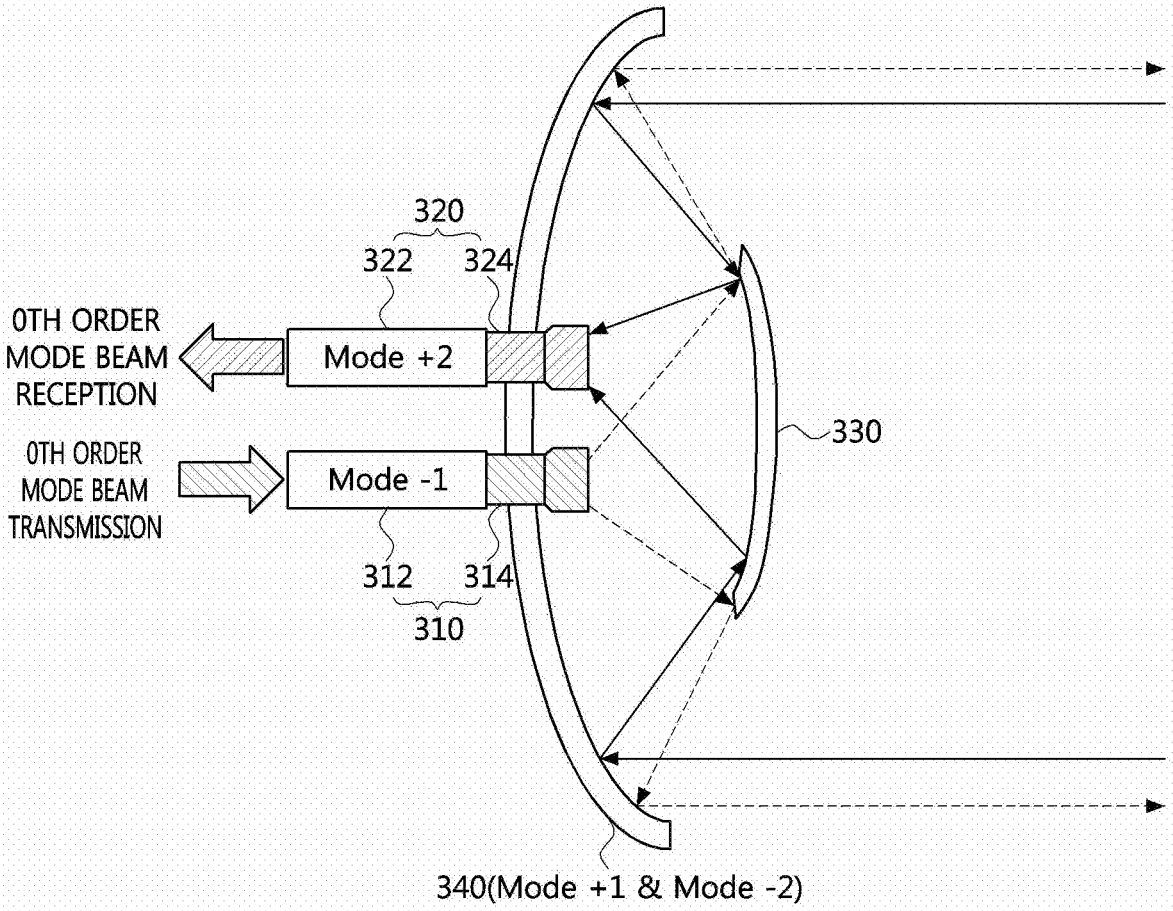
FIG. 14 is a conceptual diagram illustrating a transceiver according to a tenth embodiment of the present disclosure.

FIG. 14 is a conceptual diagram illustrating a transceiver according to a tenth embodiment of the present disclosure. In the following description of the embodiment of FIG. 14, description redundant with that of FIG. 13 will be omitted.

Referring to FIG. 14, the first mode conversion unit 312 may reduce the OAM mode order of the beam emitted from the radiator 310. For example, the first mode conversion unit 312 may change the OAM mode order of the beam by −1. The radiator 310 may emit a −1st order mode beam.

The main reflector 340 may include at least one first patch element that increases the OAM mode order of the beam and at least one secondary patch element that reduces the OAM mode order of the beam. The first patch element may change the OAM mode order of the beam by +1, and the second patch element may change the OAM mode order of the beam by −2. Therefore, OAM mode orders of some of the beams reflected at the main reflector 340 may be decreased, and OAM mode orders of the other of the beams may be increased.

The −1st order mode beam emitted by the radiator 310 may be reflected at the sub-reflector 330 and then reflected at the main reflector 340. Some of the −1st order mode beams may be reflected at the main reflector 340 and then become 0th order mode beam while others become −3rd order mode beams. In a side of receiving a signal transmitted by the transceiver, the 0th order mode beam can be selectively detected and the data transmitted by the transceiver can be demodulated.

A portion of the 0th order mode beam incident on the main reflector 340 from the outside may become a 1st order mode beam, and the other may become a −2nd order mode beam. The second mode conversion unit 322 of the receiver 320 may increase the OAM mode order of the beam incident on the receiver 320. The second mode conversion unit 322 may change the OAM mode order of the beam by +2. Only the −2nd order mode beam among the beams incident on the receiver 320 may become 0th order mode beams after passing through the second mode conversion unit 322. Therefore, the transceiver can selectively demodulate the data received from the outside by selectively detecting the 0th order mode beam.

As described above, referring to FIGS. 13 and 14, the case where the main reflector 340 includes the first patch element and the second patch element has been exemplarily described, but the embodiment is not limited thereto. For example, the sub-reflector 330 may include the first patch element and the second patch element.

In the above description, the cases where the transceiver is implemented with a Cassegrain type antenna were explained. Hereinafter, the case of implementing the transceiver with a parabolic antenna will be described.

Figure 15:
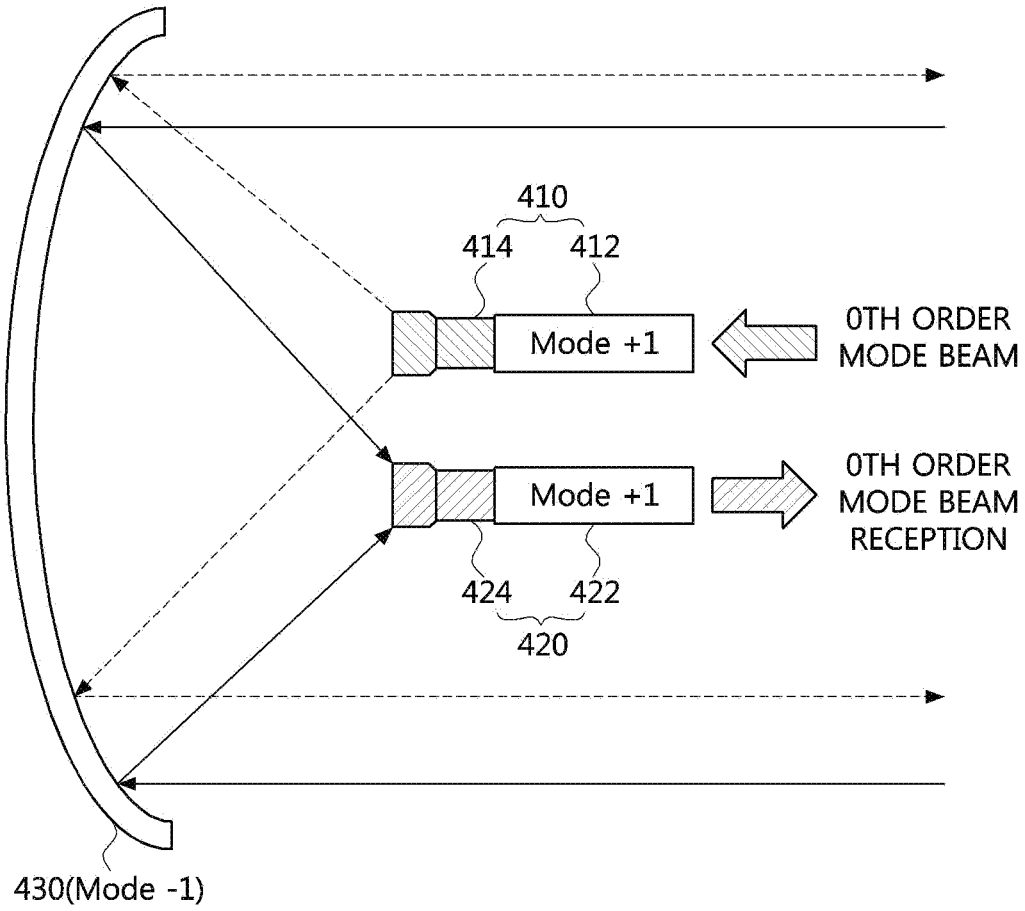
FIG. 15 is a conceptual diagram illustrating a transceiver according to an eleventh embodiment of the present disclosure.

FIG. 15 is a conceptual diagram illustrating a transceiver according to an eleventh embodiment of the present disclosure.

Referring to FIG. 15, the transceiver may include a radiator 410, a receiver 420, and a reflector 430. The radiator 410 may include a first mode conversion unit 412 and a first beam transfer unit 414. The receiver 420 may include a second mode conversion unit 422 and a second beam transfer unit 424. The reflector 430 may face the radiator 410 and the receiver 420. The beam emitted from the radiator 410 and the beam incident on the reflector 430 from the outside may have different OAMs after being reflected at the reflector 430.

The first mode conversion unit 412 may increase the OAM mode order of the beam emitted from the radiator 410. For example, the radiator 410 may emit a 1st order mode beam. The reflector 430 may reduce the OAM order of the beam reflected at the reflector 430. For example, the reflector 430 may change the OAM mode order of the beam by −1. The 1st order mode beam emitted from the radiator 410 may be reflected at the reflector 430 and then transmitted as a 0th order mode beam to the outside.

A 0th order mode beam incident on the reflector 430 from the outside may become a −1st mode beam after being reflected at the reflector 430. The −1st order mode beam reflected at the reflector 430 may be incident on the receiver 420. The second mode conversion unit 422 may increase the OAM mode order of the beam incident on the receiver 420. For example, the second mode conversion unit 422 may change the OAM mode order of the beam by +1. Thus, a −1st order mode beam incident on the receiver 420 may become a 0th order mode beam via the second mode conversion unit 422.

The beam emitted by radiator 410 may be reflected at the reflector 430 and then become a 0th order mode beam. Accordingly, even if a portion of the beam emitted from the radiator 410 is reflected at the reflector 430 and then incident on the receiver 420, it may not become a 0th order mode after passing through the second mode conversion unit 422. Therefore, the transceiver can selectively demodulate the data received from the outside by selectively detecting the 0th order mode beam. Also, interference effects between beams can be reduced.

Figure 16:
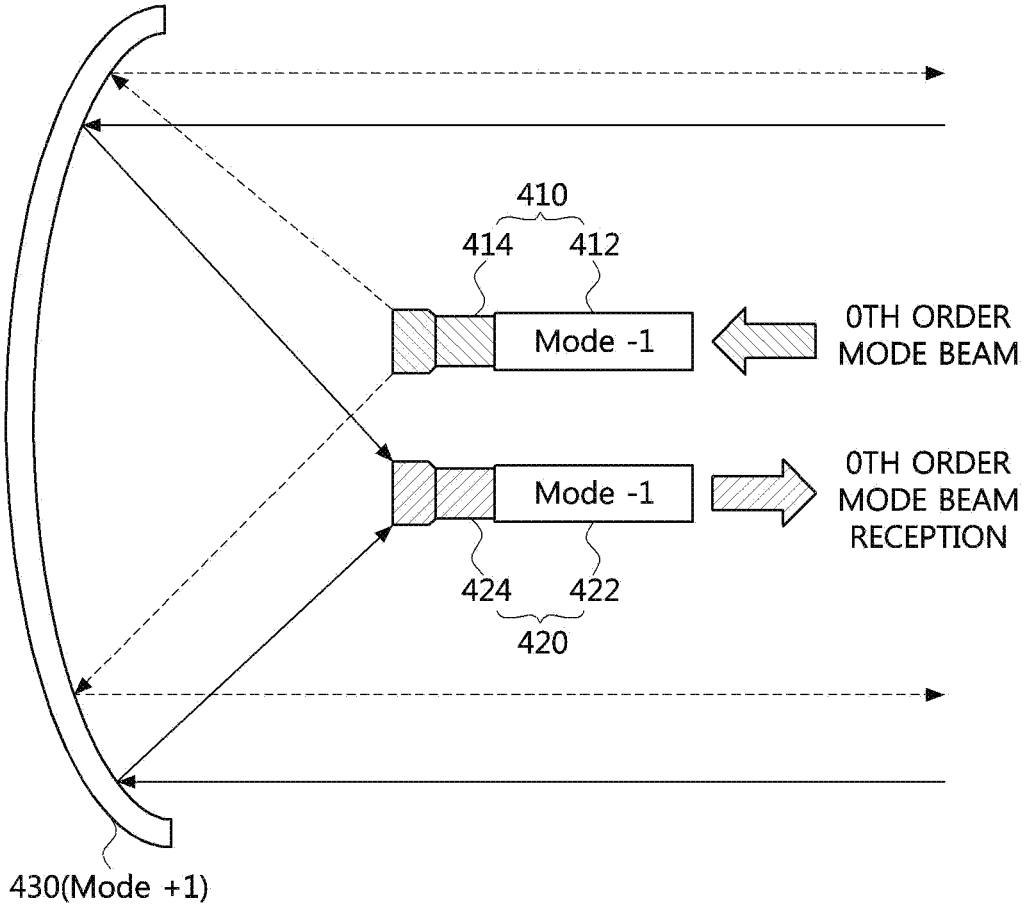
FIG. 16 is a conceptual diagram illustrating a transceiver according to a twelfth embodiment of the present disclosure.

FIG. 16 is a conceptual diagram illustrating a transceiver according to a twelfth embodiment of the present disclosure.

Referring to FIG. 16, the first mode conversion unit 412 may reduce the OAM mode order of the beam emitted from the radiator 410. For example, the radiator 410 may emit a −1st order mode beam. The reflector 430 may increase the OAM order of the beam reflected at the reflector 430. For example, the reflector 430 may change the OAM mode order of the beam by +1. The −1st order mode beam emitted from the radiator 410 may be reflected at the reflector 430 and then transmitted as a 0th order mode beam to the outside.

A 0th order mode beam incident on the reflector 430 from the outside may become a 1st mode beam after being reflected at the reflector 430. The 1st order mode beam reflected at the reflector 430 may be incident on the receiver 420. The second mode conversion unit 422 may reduce the OAM mode order of the beam incident on the receiver 420. For example, the second mode conversion unit 422 may change the OAM mode order of the beam by −1. Thus, a 1st order mode beam incident on the receiver 420 may become a 0th order mode beam via the second mode conversion unit 422.

The beam emitted by radiator 410 may be reflected at the reflector 430 and then become a 0th order mode beam. Accordingly, even if a portion of the beam emitted from the radiator 410 is reflected at the reflector 430 and then incident on the receiver 420, it may not become a 0th order mode after passing through the second mode conversion unit 422. Therefore, the transceiver can selectively demodulate the data received from the outside by selectively detecting the 0th order mode beam. Also, interference effects between beams can be reduced.

Figure 17:
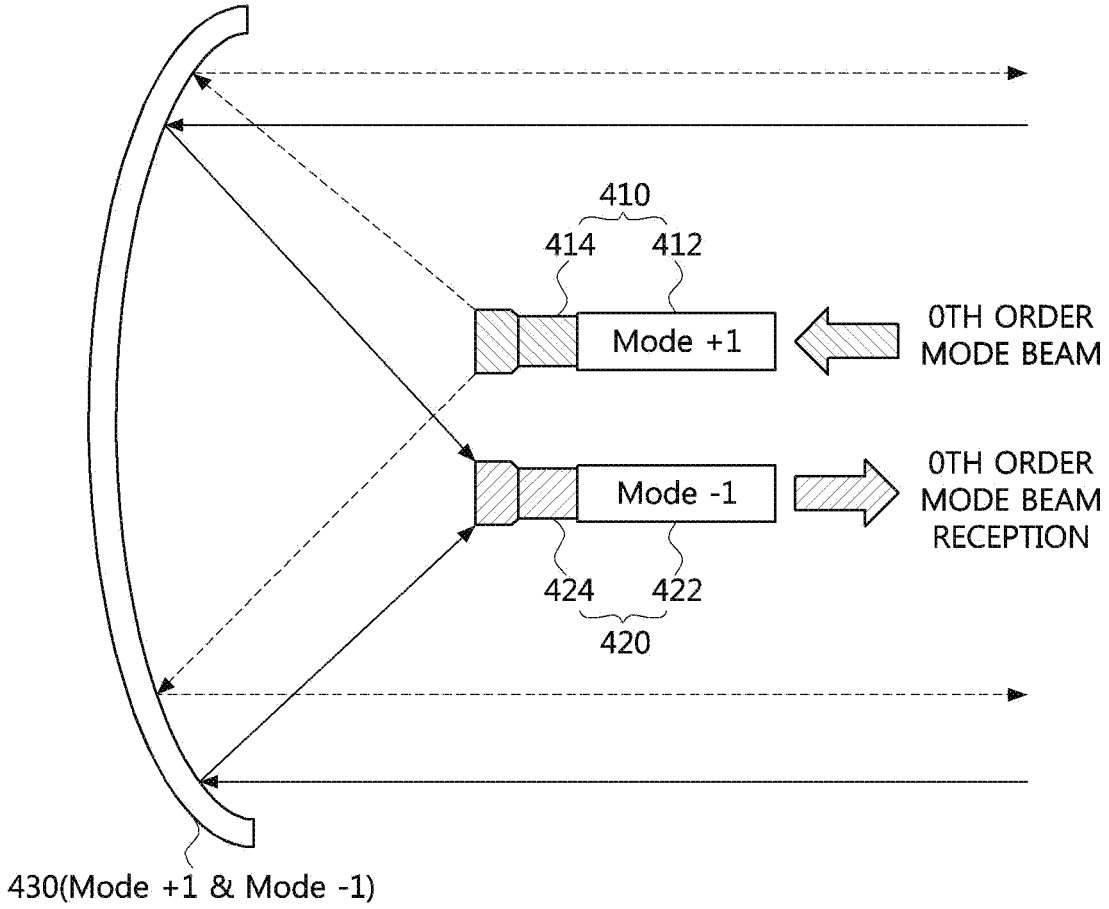
FIG. 17 is a conceptual diagram illustrating a transceiver according to a thirteenth embodiment of the present disclosure.

FIG. 17 is a conceptual diagram illustrating a transceiver according to a thirteenth embodiment of the present disclosure.

Referring to FIG. 17, the first mode conversion unit 412 may increase the OAM mode order of the beam emitted from the radiator 410. For example, the radiator 410 may emit a 1st order mode beam. The reflector 430 may include a first patch element that increases the OAM mode order of the beam and a secondary patch element that reduces the OAM mode order of the beam. Therefore, OAM mode orders of a portion of the beams reflected at the reflector 430 may be increased, and OAM mode orders of the other of the beams may be decreased. For example, the first patch element may change the OAM mode order of the beam by +1, and the second patch element may change the OAM mode order by −1.

A portion of the 1st order mode beams emitted by the radiator 410 may become a 0th order mode beam after being reflected at the reflector 430 and the other portion may become 2nd order mode beams after being reflected at the reflector 430. In a side of receiving a signal transmitted by the transceiver, the 0th order mode beam can be selectively detected and the data transmitted by the transceiver can be demodulated.

The second mode conversion unit 422 may reduce the OAM mode order of the beam incident on the receiver 420. For example, the second mode conversion unit 422 may change the OAM mode order of the beam by −1. Therefore, only the 1st order mode beam among the beams incident on the receiver 420 may become the 0th order mode beam after passing through the second mode conversion unit 422. The transceiver can selectively demodulate the data received from the outside by selectively detecting the 0th order mode beam. The beam emitted by radiator 410 may be reflected in reflector 430 and then become the 2nd order mode beam or the 0th order mode beam. Therefore, interference effect between the beams can be reduced.

In FIG. 17, the example in which the second mode conversion unit 422 decreases the OAM mode order of the beam was described, but the embodiment is not limited thereto.

For example, the second mode conversion unit 422 may change the orbital angular momentum mode degree of the beam by +1. That is, −1st order mode beams among the beams reflected at the reflector 430 may be changed to the 0th order mode beam. Since the beam emitted from the radiator 410 is reflected at the reflector 430 and then becomes the 2nd order mode beam or the 0th order mode beam, interference effect between the beams can be reduced.

Figure 18:
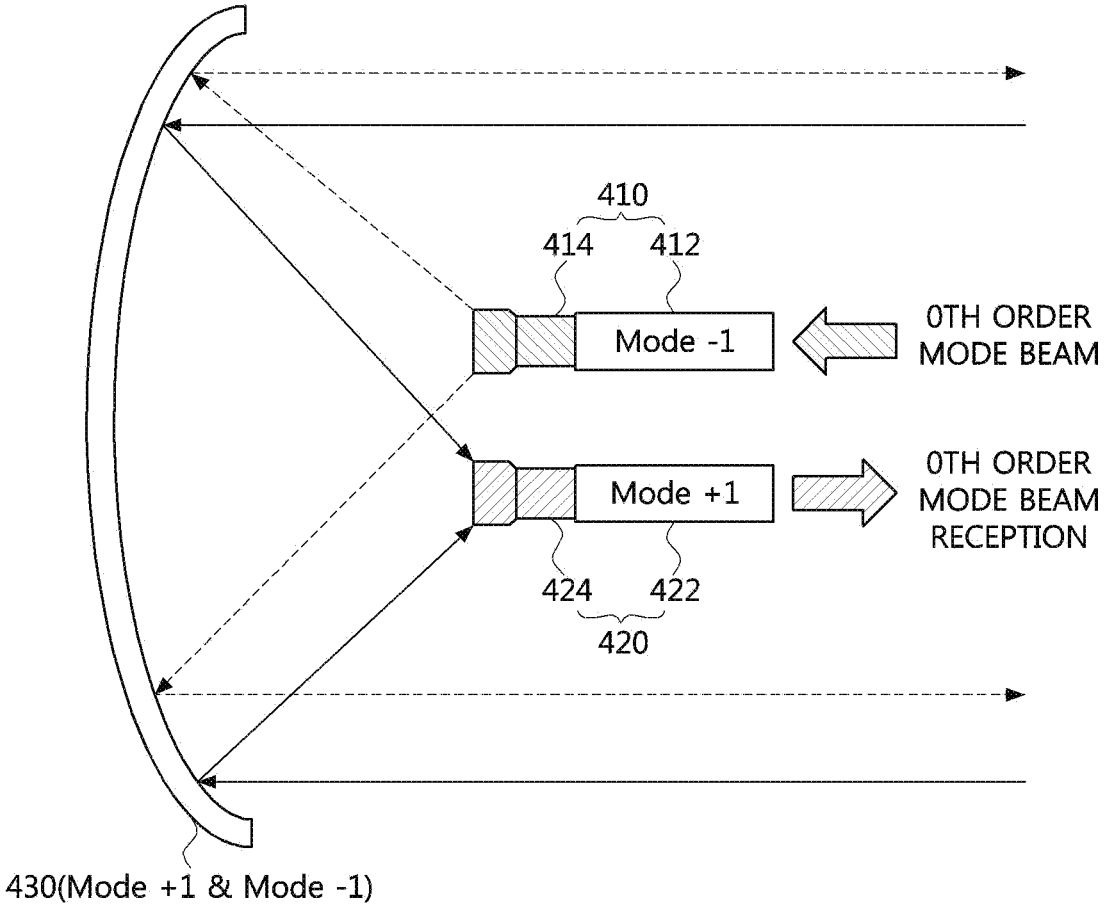
FIG. 18 is a conceptual diagram illustrating a transceiver according to a fourteenth embodiment of the present disclosure.

FIG. 18 is a conceptual diagram illustrating a transceiver according to a fourteenth embodiment of the present disclosure.

Referring to FIG. 18, the first mode conversion unit 412 may reduce the OAM mode order of the beam emitted from the radiator 410. For example, the radiator 410 may emit a −1st order mode beam. The reflector 430 may include a first patch element that increases the OAM mode order of the beam and a secondary patch element that reduces the OAM mode order of the beam. Therefore, OAM mode orders of a portion of the beams reflected at the reflector 430 may be increased, and OAM mode orders of the other of the beams may be decreased. For example, the first patch element may change the OAM mode order of the beam by +1, and the second patch element may change the OAM mode order by −1.

A portion of the −1st order mode beams emitted by the radiator 410 may become a 0th order mode beam after being reflected at the reflector 430 and the other portion may become −2nd order mode beams after being reflected at the reflector 430. In a side of receiving a signal transmitted by the transceiver, the 0th order mode beam can be selectively detected and the data transmitted by the transceiver can be demodulated.

The second mode conversion unit 422 may increase the OAM mode order of the beam incident on the receiver 420. For example, the second mode conversion unit 422 may change the OAM mode order of the beam by +1. Therefore, only the −1st order mode beam among the beams incident on the receiver 420 may become the 0th order mode beam after passing through the second mode conversion unit 422. The transceiver can selectively demodulate the data received from the outside by selectively detecting the 0th order mode beam. The beam emitted by radiator 410 may be reflected in reflector 430 and then become −2nd order mode beam or 0th order mode beam. Therefore, interference effect between the beams can be reduced.

In FIG. 18, the example in which the second mode conversion unit 422 increases the OAM mode order of the beam was described, but the embodiment is not limited thereto. For example, the second mode conversion unit 422 may change the orbital angular momentum mode degree of the beam by −1. That is, 1st order mode beams among the beams reflected at the reflector 430 may be changed to 0th order mode beams. Since the beams emitted from the radiator 410 are reflected at the reflector 430 and then become −2nd order mode beams or 0th order mode beams, interference effect between the beams can be reduced.

Hereinabove, the transceivers according to the embodiments of the present disclosure have been described with reference to FIGS. 1 to 18. According to the above-described embodiments, orthogonality between beams can be ensured by using the OAM mode of the beams. Through this, in a full duplex environment, interference effect between the beams emitted from the radiator and the beams received from the outside can be remarkably reduced.

While the embodiments of the present disclosure and their advantages have been described in detail, it should be understood that various changes, substitutions and alterations may be made herein without departing from the scope of the present disclosure.

What is claimed is:

1. A transceiving apparatus comprising:

a radiator emitting a first beam with a first orbital angular momentum (OAM) mode;

a receiver receiving a second beam with the first OAM mode;

a first sub-reflector which is provided to face the radiator and reflects the first beam emitted from the radiator;

a second sub-reflector which is provided to face the receiver and reflects the second beam to the receiver; and a main reflector which is provided to face the first sub-reflector and the second sub-reflector, wherein an OAM mode of the first beam is changed from a second OAM mode to the first OAM mode by the radiator, the OAM mode of the first beam emitted from the radiator is changed from the first OAM mode to the second OAM mode by the first sub-reflector, the OAM mode of the second beam is changed from the second OAM mode to the first OAM mode by the second sub-reflector, and the OAM mode of the second beam reflected by the second sub-reflector is changed from the first OAM mode to the second OAM mode by the receiver.

2. The transceiving apparatus according to claim 1, wherein the first sub-reflector decreases an order of the OAM mode of the first beam, and the second sub-reflector increases an order of the OAM mode of the second beam.

3. The transceiving apparatus according to claim 2, wherein the radiator includes a first mode conversion unit increasing the order of the OAM mode of the first beam incident on the radiator, and the receiver includes a second mode conversion unit decreasing the order of the OAM mode of the second beam incident on the receiver.

4. The transceiving apparatus according to claim 1, wherein the first sub-reflector increases an order of the OAM mode of the first beam, and the second sub-reflector decreases an order of the OAM mode of the second beam.

5. The transceiving apparatus according to claim 4, wherein the radiator includes a first mode conversion unit decreasing the order of the OAM mode of the first beam incident on the radiator, and the receiver includes a second mode conversion unit increasing an the order of the OAM mode of the second beam incident on the receiver.

6. The transceiving apparatus according to claim 1, wherein the main reflector includes at least one first patch element increasing an order of the OAM mode of the first beam reflected at the main reflector, and at least one second patch element decreasing an order of the OAM mode of the second beam reflected at the main reflector.

7. The transceiving apparatus according to claim 6, wherein the first sub-reflector decreases the order of the OAM mode of the first beam reflected at the first sub-reflector, and the second sub-reflector increases the order of the OAM mode of the second beam reflected at the second sub-reflector.

8. The transceiving apparatus according to claim 6, wherein the first sub-reflector increases the order of the OAM mode of the first beam reflected at the first sub-reflector, and the second sub-reflector decreases the order of the OAM mode of the second beam reflected at the second sub-reflector.

9. A transceiving apparatus comprising:

a radiator which emits a first beam with a first orbital angular momentum (OAM) mode and includes a first mode conversion unit changing an (OAM) mode of the first beam incident on the radiator;

a receiver which receives a second beam with the first OAM mode and includes a second mode conversion unit changing an OAM mode of the received the second beam;

a sub-reflector provided to face the radiator and the receiver and reflects the first beam emitted from the radiator and the second beam to the receiver; and a main reflector provided to face the sub-reflector, wherein an OAM mode of the first beam is changed from a second OAM mode to the first OAM mode by the radiator, the OAM mode of the first beam emitted from the radiator is changed from the first OAM mode to the second OAM mode by the sub-reflector, the OAM mode of the second beam is changed from the second OAM mode to the first OAM mode by the sub-reflector, and the OAM mode of the second beam reflected by the sub-reflector is changed from the first OAM mode to the second OAM mode by the receiver, wherein at least one of the main reflector and the sub-reflector changes the OAM mode of the beams so that the second beam incident on the main reflector from an outside of the transceiving apparatus has a different OAM mode with the first beam emitted by the radiator after being reflected at the sub-reflector.

10. The transceiving apparatus according to claim 9, wherein the first mode conversion unit increases an order of the OAM mode of the first beam incident on the radiator, the sub-reflector decreases an order of the OAM mode of the first beam reflected at the sub-reflector, and the second mode conversion unit increases an order of the OAM mode of the second beam incident on the receiver.

11. The transceiving apparatus according to claim 9, wherein the first mode conversion unit decreases an order of the OAM mode of the first beam incident on the radiator, the sub-reflector increases an order of the OAM mode of the first beam reflected at the sub-reflector, and the second mode conversion unit decreases an order of the OAM mode of the second beam incident on the receiver.

12. The transceiving apparatus according to claim 9, wherein the first mode conversion unit increases an order of the OAM mode of the first beam incident on the radiator, the main reflector decreases an order of the OAM mode of the first beam reflected at the main reflector, and the second mode conversion unit increases an order of the OAM mode of the second beam incident on the receiver.

13. The transceiving apparatus according to claim 9, wherein the first mode conversion unit decreases an order of the OAM mode of the first beam incident on the radiator, the main reflector increases an order of the OAM mode of the first beam reflected at the main reflector, and the second mode conversion unit decreases an order of the OAM mode of the second beam incident on the receiver.

14. The transceiving apparatus according to claim 9, wherein at least one of the main reflector and the sub-reflector includes at least one first patch element increasing an order of the OAM mode of the first beam, and at least one second patch element decreasing an order of the OAM mode of the second beam.

15. A transceiving apparatus comprising:

a radiator which emits a first beam with a first orbital angular momentum (OAM) mode and includes a first mode conversion unit changing an (OAM) mode of the first beam incident on the radiator;

a receiver which receives a second beam with the first OAM mode and includes a second mode conversion unit changing an OAM mode of the received the second beam; and a reflector provided to face the radiator and the receiver and reflects the first beam emitted from the radiator and the second beam to the receiver, wherein an OAM mode of the first beam is changed from a second OAM mode to the first OAM mode by the radiator, the OAM mode of the first beam emitted from the radiator is changed from the first OAM mode to the second OAM mode by the reflector, the OAM mode of the second beam is changed from the second OAM mode to the first OAM mode by the reflector, and the OAM mode of the second beam reflected by the reflector is changed from the first OAM mode to the second OAM mode by the receiver, wherein the second beam incident on the reflector from an outside of the transceiving apparatus has a different OAM mode with the first beam emitted by the radiator after being reflected at the reflector.

16. The transceiving apparatus according to claim 15, wherein the first mode conversion unit increases an order of the OAM mode of the first beam incident on the radiator, the reflector decreases an order of the OAM mode of the first beam reflected at the reflector, and the second mode conversion unit increases an order of the OAM mode of the second beam incident on the receiver.

17. The transceiving apparatus according to claim 15, wherein the first mode conversion unit decreases an order of the OAM mode of the first beam incident on the radiator, the reflector increases an order of the OAM mode of the first beam reflected at the reflector, and the second mode conversion unit decreases an order of the OAM mode of the second beam incident on the receiver.

18. The transceiving apparatus according to claim 15, wherein the reflector includes at least one first patch element increasing an order of the OAM mode of the first beam reflected at the reflector, and at least one second patch element decreasing an order of the OAM mode of the second beam reflected at the reflector.

19. The transceiving apparatus according to claim 18, wherein the first mode conversion unit increases the order of the OAM mode of the first beam incident on the radiator.

20. The transceiving apparatus according to claim 18, wherein the first mode conversion unit decreases the order of the OAM mode of the first beam incident on the radiator.

* * * * *